US010763586B2

(12) United States Patent
Stowell

(10) Patent No.: US 10,763,586 B2
(45) Date of Patent: Sep. 1, 2020

(54) ANTENNA WITH FREQUENCY-SELECTIVE ELEMENTS

(71) Applicant: Lyten, Inc., Sunnyvale, CA (US)

(72) Inventor: Michael W. Stowell, Sunnyvale, CA (US)

(73) Assignee: LytEn, Inc., Sunnyvale, CA (US)

( * ) Notice: Subject to any disclaimer, the term of this patent is extended or adjusted under 35 U.S.C. 154(b) by 8 days.

(21) Appl. No.: 16/282,895

(22) Filed: Feb. 22, 2019

(65) Prior Publication Data

US 2019/0190154 A1 Jun. 20, 2019

Related U.S. Application Data

(63) Continuation of application No. 15/944,482, filed on Apr. 3, 2018, now Pat. No. 10,218,073.
(Continued)

(51) Int. Cl.

| | |
|---|---|
| ***H01Q 11/04*** | (2006.01) |
| ***H01Q 9/42*** | (2006.01) |
| ***H01Q 9/04*** | (2006.01) |
| ***H01Q 1/24*** | (2006.01) |
| ***H01Q 1/36*** | (2006.01) |
| ***H01Q 15/00*** | (2006.01) |
| ***H01Q 5/364*** | (2015.01) |
| *H01Q 1/42* | (2006.01) |

(52) U.S. Cl.
CPC ..... *H01Q 9/0407* (2013.01); *H01Q 1/248* (2013.01); *H01Q 1/36* (2013.01); *H01Q 5/364* (2015.01); *H01Q 9/42* (2013.01); *H01Q 11/04* (2013.01); *H01Q 15/0013* (2013.01); *H01Q 1/422* (2013.01)

(58) Field of Classification Search
CPC ..... H01Q 9/0407; H01Q 11/04; H01Q 9/42; H01Q 1/36; H01Q 5/364; H01Q 15/0013; H01Q 1/24; H01Q 1/248
See application file for complete search history.

(56) References Cited

U.S. PATENT DOCUMENTS 6,107,920 A 8/2000 Eberhardt et al.
6,300,914 B1 10/2001 Yang
(Continued)

FOREIGN PATENT DOCUMENTS

JP 2002321725 A 11/2002
JP 6071964 B2 2/2017
(Continued)

OTHER PUBLICATIONS

International Search Report dated Jul. 26, 2018 for PCT Patent Application No. PCT/US2018/025939.
(Continued)

*Primary Examiner* — Hoang V Nguyen
(74) *Attorney, Agent, or Firm* — Paradice & Li LLP

(57) ABSTRACT

Antenna systems have a substrate and antenna on the substrate, where the antenna has a plurality of leg elements. The plurality of leg elements comprises a conductive ink and forms a continuous path. At least one of the plurality of leg elements is individually selectable or de-selectable to change a resonant frequency of the antenna, and leg elements that are selected create an antenna path length corresponding to the resonant frequency. In some embodiments, the antennas are energy harvesters.

21 Claims, 17 Drawing Sheets

Related U.S. Application Data

(60) Provisional application No. 62/508,295, filed on May 18, 2017, provisional application No. 62/482,806, filed on Apr. 7, 2017, provisional application No. 62/481,821, filed on Apr. 5, 2017.

(56) References Cited

U.S. PATENT DOCUMENTS

| | | | | |
|---|---|---|---|---|
| 6,317,101 | B1 | 11/2001 | Dockery | |
| 6,667,092 | B1 | 12/2003 | Brollier et al. | |
| 6,856,291 | B2 | 2/2005 | Mickle et al. | |
| 7,057,562 | B2 | 6/2006 | Forster et al. | |
| 7,400,253 | B2 | 7/2008 | Cohen | |
| 7,479,886 | B2 | 1/2009 | Burr | |
| 7,606,540 | B2 | 10/2009 | Yoon | |
| 7,847,697 | B2 | 12/2010 | Banerjee et al. | |
| 7,891,569 | B2 | 2/2011 | Gelbman | |
| 8,045,947 | B2 | 10/2011 | Mandal et al. | |
| 8,115,684 | B2 | 2/2012 | Palin | |
| 8,299,927 | B2 | 10/2012 | Lawrence et al. | |
| 8,552,597 | B2 | 10/2013 | Song et al. | |
| 8,952,792 | B1 | 2/2015 | Srinivas et al. | |
| 9,537,205 | B2 | 1/2017 | Hsieh et al. | |
| 9,548,543 | B2 | 1/2017 | Subbaraman et al. | |
| 9,871,298 | B2 | 1/2018 | Daniel et al. | |
| 2007/0229376 | A1 | 10/2007 | Desclos et al. | |
| 2010/0026590 | A1 | 2/2010 | Chiang et al. | |
| 2012/0007913 | A1 | 1/2012 | Jang et al. | |
| 2012/0106103 | A1 | 5/2012 | Nohra | |
| 2012/0235879 | A1 | 9/2012 | Eder et al. | |
| 2014/0049430 | A1 | 2/2014 | Koski | |
| 2015/0207230 | A1* | 7/2015 | Oh | H01Q 7/00 343/702 |
| 2015/0364822 | A1 | 12/2015 | O'Driscoll | |
| 2016/0164171 | A1 | 6/2016 | Lai | |
| 2016/0181868 | A1* | 6/2016 | Casse | H01Q 1/248 307/104 |
| 2016/0181873 | A1 | 6/2016 | Mitcheson et al. | |
| 2016/0198576 | A1 | 7/2016 | Lewis et al. | |
| 2016/0261031 | A1 | 9/2016 | Dion et al. | |
| 2016/0353578 | A1 | 12/2016 | Yang et al. | |
| 2017/0077593 | A1 | 3/2017 | Cheng et al. | |

FOREIGN PATENT DOCUMENTS

| | | | |
|---|---|---|---|
| KR | 20070068182 | A | 6/2007 |
| KR | 101090747 | B1 | 12/2011 |
| WO | 2016081779 | A1 | 5/2016 |
| WO | 2017208231 | A1 | 12/2017 |

OTHER PUBLICATIONS

Kimionis, et al., "3D-Printed Origami Packaging With Inkjet-Printed Antennas for RF Harvesting Sensors," IEEE Transactions on Microwave Theory and Techniques, vol. 63, No. 12, Dec. 2015, pp. 4521-4532.

Notice of Allowance dated Oct. 24, 2018 for U.S. Appl. No. 15/944,482.

Paing et al., "Resistor Emulation Approach to Low-Power RF Energy Harvesting," IEEE Transactions on Power Electronics, Vo. 23, No. 3, May 2008, pp. 1494-1501.

Sajal, et al., "A Conformal Antenna on a Passive UHF RFID tag using 97% Carbon Content Graphene-Based Conductors and Paper Substrates," IEEE International Symposium on Antennas and Propagation & USNC/URSI National Radio Science Meeting, Jul. 2017, pp. 2427-2428.

Shrestha, et al., "Comparative Study of Antenna Designs for RF Energy Harvesting," Hindawi Publishing Corporation, International Journal of Antennas and Propagation, vol. 2013, Jan. 2013, Article 385260, pp. 1-10.

Tentzeris et al., "Novel Energy Harvesting Technologies for ICT Applications," International Symposium on Applications and the Internet, Aug. 2008 IEEE, pp. 373-376.

* cited by examiner

ANTENNA WITH FREQUENCY-SELECTIVE ELEMENTS

RELATED APPLICATIONS

This application is a continuation of U.S. patent application Ser. No. 15/944,482, filed on Apr. 3, 2018 and entitled "Antenna with Frequency-Selective Elements"; which claims priority to: 1) U.S. Provisional Patent Application No. 62/481,821, filed on Apr. 5, 2017 and entitled "Power Management in Energy Harvesting"; 2) U.S. Provisional Patent Application No. 62/482,806, filed on Apr. 7, 2017 and entitled "Dynamic Energy Harvesting Power Architecture"; and 3) U.S. Provisional Patent Application No. 62/508,295, filed on May 18, 2017 and entitled "Carbon-Based Antenna"; all of which are hereby incorporated by reference for all purposes.

BACKGROUND

Wireless devices have become an integral part of society as data tracking and mobile communications have been incorporated into a wide variety of products and practices. For example, radiofrequency identification (RFID) systems are commonly used to track and identify objects such as products being shipped, vehicles passing through transit points, inventory in a warehouse or on an assembly line, and even animals and people via RFID trackers that are implanted or worn. Internet of Things (IoT) is another area in which wireless devices are used, where networked devices are connected together to communicate information to each other. Examples of IoT applications include smart appliances, smart homes, voice-controlled assistants, wearable technologies, and monitoring systems such as for security, energy and the environment.

Since many applications require these wireless electronic devices to be very small and portable, thereby limiting the manner in which the devices can be electrically powered, energy harvesting (EH) is often utilized as an additional energy source for the devices. Energy harvesting is generally a process by which energy is derived by an energy harvesting component or device from a variety of energy sources that radiate or broadcast energy intentionally, naturally, or as a byproduct or side effect. Types of energy that can be harvested include electromagnetic (EM) energy, solar energy, thermal energy, wind energy, salinity gradients, and kinetic energy, among others. For example, temperature gradients occur in a region surrounding an operating combustion engine. In urban areas there is a large amount of EM energy in the environment because of radio and television broadcasting. Energy harvesting circuits or devices can thus be placed in, on or near these regions or environments to take advantage of the presence of these energy sources, even though the energy level from these types of energy sources may be highly variable or unreliable. For instance, antennas can be used to capture radiofrequency (RF) energy from EM sources such as cell phones, WiFi networks, and televisions. Energy harvesting is generally distinguished from a direct supply of energy provided through dedicated hardwired power transmission lines, such as that provided by an electrical power utility company through a power grid to specific customers, each of which is an added power load for the energy source.

In some situations, the energy available for harvesting is also known as background, ambient or scavenged energy that is not specifically intended to be transmitted to any particular customer or receiver for the purpose of powering a receiving device. An example of background or ambient energy is the natural EM radiation emitted as an unavoidable side effect or byproduct of many types of electrical devices or transmission lines. Radio frequency broadcasts from ground, air or satellite radio transmitters, in contrast, may be intended to be used by a receiver for telecommunication purposes, but that radio frequency energy (which is EM radiation) is also capable of being used for unintended energy harvesting purposes. In these "unintentional" situations, the energy harvesting circuit simply intercepts the ambient energy whenever or wherever it is available, without being an added power load for the energy source. In other situations, a dedicated wireless EM energy transmitter can be provided to broadcast or beam EM radiation where energy harvesting circuits or devices are known to be present for intentional harvesting or capturing by the energy harvesting circuits or devices, thereby providing an "intentional" wireless power transmission system for specific electrical devices. From the point of view of the energy harvesting circuit or device, however, the intentional EM radiation from the EM energy transmitter is the same or similar to the ambient (unintentional) energy, except that the intentional situation may result in a more reliable energy source. Both intentional and unintentional transmitted energy can be used for energy harvesting.

The harvested energy is generally captured for use or stored for future use by small, typically wireless, typically autonomous electronic circuits, components or devices, such as those used in some types of wearable electronics and wireless sensor devices or networks. Energy harvesting circuits or devices, thus, typically provide a very small amount of power for low-energy electronic circuits or devices electrically connected to, integrated with, or otherwise associated with the energy harvesting circuits or devices. These energy harvesting circuits are typically a supplemental power source to a battery on the device, as the EH sources do not provide sufficient power for the entire device or do not provide consistent power.

Antennas play an important role in the ability to harvest energy efficiently. The development of antennas for energy harvesting as well as for communication in wireless and IoT devices has involved studies to minimize size, increase efficiency, achieve multi-band frequencies, and investigate different antenna materials. Antennas have been incorporated into housings for mobile devices, into implantable devices, and onto smart cards and packaging. RFID antennas are often deposited onto the surfaces of labels for packaging or displays, such as small size peel-and-stick labels. Some antennas have been fabricated by printing—such as by silk-screening, flexographic, or ink-jet. Silver inks are the most commonly used ink for electrically conductive components, although carbon and polymer-based inks have also been used. As wireless devices become increasingly widespread, there is a continuing need for more efficient, cost-effective antennas.

SUMMARY

In some embodiments an antenna system has a substrate and antenna on the substrate, where the antenna has a plurality of leg elements. The plurality of leg elements comprises a conductive ink and forms a continuous path. At least one of the plurality of leg elements is individually selectable or de-selectable to change a resonant frequency of the antenna, and leg elements that are selected create an antenna path length corresponding to the resonant frequency.

In some embodiments, an energy harvesting system includes an antenna system and an electronic circuit. The antenna system includes a substrate and an antenna on the substrate. The antenna has a plurality of leg elements, where the plurality of leg elements comprises a carbon-based conductive ink and forms a continuous path. Each of the plurality of leg elements is individually selectable or de-selectable to change a resonant frequency of the antenna. Leg elements that are selected create an antenna path length corresponding to the resonant frequency. The electronic circuit has connections to each of the plurality of leg elements, where the electronic circuit is configured to actively de-select a first leg element in the plurality of leg elements by short-circuiting the first leg element to a second leg element in the plurality of leg elements.

In some embodiments, an antenna system includes a substrate and an antenna on the substrate. The antenna has a plurality of leg elements, the plurality of leg elements comprising a conductive ink and forming a continuous path. A first leg element in the plurality of leg elements has a first resonant frequency threshold that is dependent on a received frequency and a first electrical impedance of the first leg element. The first electrical impedance is based on a material property selected from the group consisting of: a permeability, a permittivity, and a conductivity. The first leg element is individually de-selectable to change a resonant frequency of the antenna by changing an antenna path length, the first leg element being passively de-selected from the antenna path length by being inactive when the received frequency is above the first frequency threshold.

DETAILED DESCRIPTION

Figure 1A:
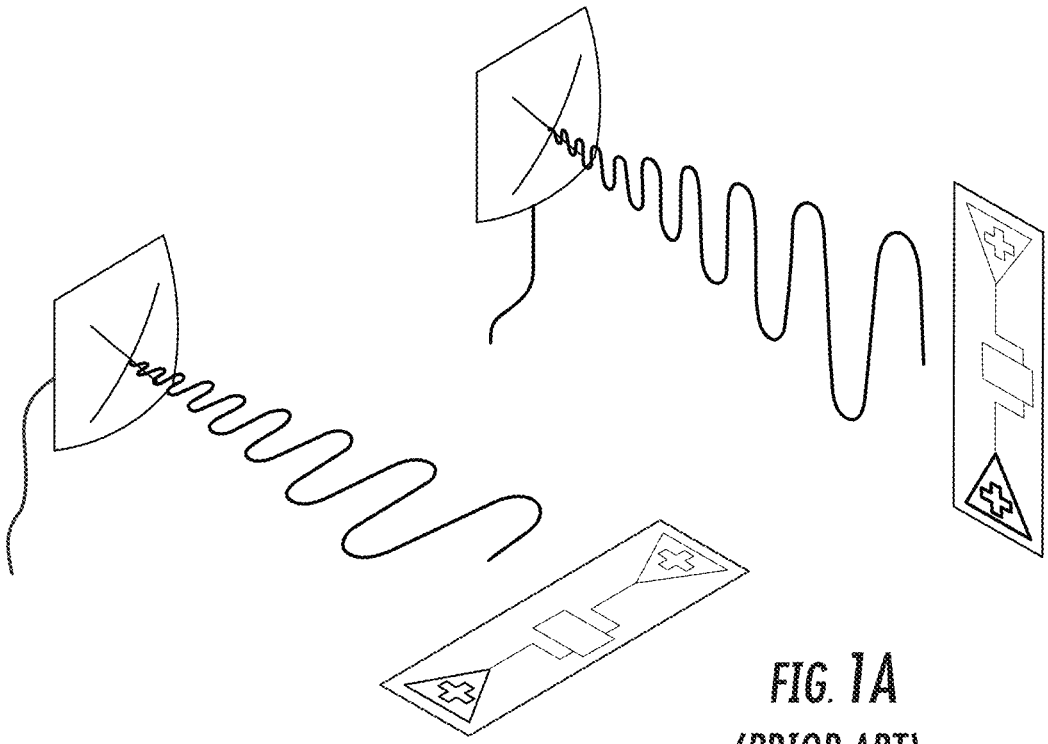
FIG. 1A (PRIOR ART)
FIGS. 1A-1B are diagrams describing antenna polarization, as known in the art.

The present disclosure describes printed antennas that have multiple leg elements, where the leg elements are individually selectable or de-selectable to be active for a desired frequency. By utilizing different portions of the antenna, the antenna path length—that is, the portions of a given antenna pattern that are active—can be adjusted so that energy for a certain frequency is harvested. That is, the present antennas have a dynamically changeable resonant frequency, where antenna elements are switched in and out to change the path length. The present antenna systems act as broadband antennas that can see many frequencies, where the system finds which frequency is the most dominant power source and changes the components and elements of the antenna system for maximum power reception.

In some embodiments, the selection of leg elements occurs passively by tuning each leg element to have a certain electrical impedance which results in a resonant frequency threshold above which the leg element will no longer respond. The tuning of the electrical impedance can be achieved by adjusting the material used to print the leg elements, such as using inks with different electromagnetic permeability, permittivity, and/or electrical conductivity. The type of material used to fabricate the leg elements can also be varied to affect the antenna's frequency response characteristics. When the antenna receives a frequency, the leg element will be active if the received frequency is below the resonant frequency threshold of that particular leg element, and will be inactive if the received frequency is above the threshold. The total path length of the active leg elements at a given time thus changes the overall resonant frequency of the antenna.

In other embodiments, the selection of leg elements occurs actively by electronic switching that short-circuits leg elements together, thereby de-selecting a leg element and decreasing the antenna path length. The electronic switching is achieved by an electronic circuit, such as a microprocessor, coupled to the leg elements of the antenna.

In some embodiments, the tunable resonant frequencies of the leg elements can be achieved by the geometry of the antenna elements, such as by using tapered segments. In some embodiments, a dielectric material can also be printed between leg elements of the antenna to adjust the capacitance of the overall antenna.

In some embodiments, the present antennas can be configured as two-dimensional planar designs. The planar antennas can extend over one or more faces of an object made from the substrate, such as a shipping box.

In further embodiments, the antennas themselves have a three-dimensional (3D) geometry integrated within the substrate. The 3D antennas have multiple conductors that are printed onto components of the substrate, where the components are joined and stacked together to form the substrate. The present 3D antennas uniquely utilize 3D features of a substrate material, such as the multi-layer construction of corrugated cardboard and 3D features of the corrugated layer itself. Embodiments of 3D antennas can increase the surface area of the antenna over two-dimensional (planar) designs. A greater surface area increases the amount of energy that can be harvested and/or improves reception and transmission for communication. The 3D antennas can also be adjusted to operate at various frequencies by altering the path length of the antenna through selectable leg elements.

The antennas of the present embodiments can be printed on a variety of substrates, including paper-based materials such as labels, cards, and packaging such as cardboard; or on non-paper materials such as glass or plastic. The present antennas can be printed using any conductive material, such as metals and carbon-based inks. The carbon inks may contain structured carbons such as graphenes and carbon nano-onions, or mixtures thereof.

Attributes of the present embodiments include an innately flexible antenna technology, and enhanced RFID range and flexibility. Applications of the present antenna systems include: personnel telemetry badge or clothing; group-wise energy harvesting and communication; autonomous and swarm data telemetry and data collection; hands-off shipment transaction; inventory control including ports authority; location and internal contents control; monitoring temperature, humidity, shock, etc. of perishables; and energy harvested powering or charging of internal product or connected circuitry.

Although the embodiments shall be described primarily in terms of dipole antennas, the concepts apply to any type of antennas including array antennas and slot antennas. Slot antennas, typically used at frequencies between 300 MHz and 24 GHz, are popular because they can be cut out of whatever surface they are to be mounted on and have radiation patterns that are roughly omnidirectional (similar to a dipole antenna). The polarization of the slot antenna is linear. The slot size, shape and what is behind it (the cavity) offer design variables that can be used to tune performance. To increase the directivity of an antenna, one solution is to use a reflector. For example, starting with a wire antenna (e.g., a half-wave dipole antenna), a conductive sheet can be placed behind it to direct radiation in the forward direction. To further increase the directivity, a corner reflector may be used. Microstrip or patch antennas are becoming increasingly useful because they can be printed directly onto a circuit board.

The embodiments shall be described primarily in relation to energy harvesting, where the antenna is an energy harvester by absorbing energy. However, the concepts also apply to transmission and reception of data of all types, such as but not limited to, digital, analog, voice, and television signals.

Conventional Antennas

Design factors for enhancing the reception of a wireless two-dimensional (2D) planar antenna shall first be described. One consideration in antenna design is the antenna gain. Simply put, a higher gain antenna increases the power received from the antenna. To insure that antennas have the longest reach, high gain antenna designs are needed (e.g., 9 dBi, or higher). In short, the higher the gain, the higher the range of the antenna, and vice-versa. Another consideration is size and orientation. For orientation, the best range from any antenna is achieved by making sure the antenna is fully facing or properly oriented with respect to the source. Regarding size, as a general rule of thumb small antennas will have shorter ranges, and large antennas will have longer ranges. Passive RFID antennas can vary in antenna range from a few inches to over 50 feet. Because larger antennas will broadcast farther than smaller antennas, in general the larger the antenna, the longer the antenna's range.

Figure 1B:
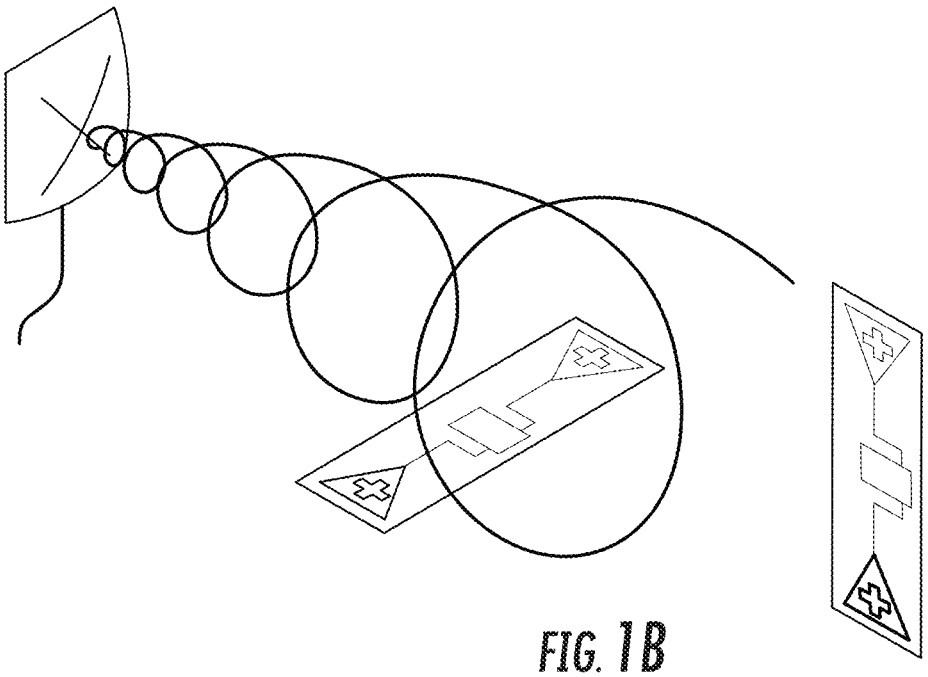
FIG. 1B (PRIOR ART)

Antenna polarization is another consideration in 2D (planar) antenna design, as illustrated in FIGS. 1A-1B. Polarization refers to type of electromagnetic field the antenna is generating. Linear polarization, shown in FIG. 1A, refers to radiation along a single plane. Circular polarization, shown in FIG. 1B, refers to antennas that split the radiated power across two axes and then "spin" the field to cover as many planes as possible. If antennas are aligned with the source polarization, absorption is enhanced, where linear polarized antennas will receive more than circular polarized antennas. Additionally, because for linear antennas the power is not split across more than one axis, a linear antenna's field will extend farther than that of a circular antenna with comparable gain, thus allowing for longer antenna range when aligned with the antenna source. If antennas are not aligned with the source's polarization, then circular polarized antennas will have a field that extends farther than linear polarized antennas.

Resistivity is yet another consideration in 2D antenna design, where increased conductor resistivity decreases antenna reception. Printed antennas have been considered in the industry in order to achieve an RFID technology that can be fully integrated into material fabrication lines, such as manufacturing of packaging. A drawback with printed antennas, however, is their reduced radiation efficiency compared to their copper counterparts, as the bulk conductivity of their printed traces is lower than for solid metals. The main drawback of printed antennas is their limited conductivity when compared to fabricating antennas from solid metals. Basic laws for conductors and conductivity state that ohmic losses decrease as conductor thickness increases. Even though printed ink traces are not homogenous, a similar behavior will also apply to printed traces. An electrical transmission line of a given length and width, and printed with a particular ink thickness, has a total resistance proportional to the length and inversely proportional to the trace width and thickness. Ohmic losses are a much more severe contribution to loss in radiation efficiency than that introduced by an impedance mismatch. This is expressed by the equation:

$$e_{CONDUCTOR}=e_{MISMATCH}\cdot e_{OHMIC} \quad \text{(Eq. 1)}$$

With the growth of telemetry demands and advanced features of wireless electronics, increased operational power is required. There is a need for improved large-scale antennas, and at the same cost as existing antennas.

Improvements in other aspects of energy harvesting are also desirable for telemetry and IoT applications, such as being able to harvest various frequencies that are available in an ambient environment. Some conventional multi-band antenna systems utilize rectifying circuits to achieve impedance matching with the antenna. Other known antenna designs include multiple antennas, each designed for a certain frequency, where a circuit switches between the different antennas. Another known type of antenna is a fractal broadband antenna, which utilizes a fractal pattern. The fractal pattern enables multiple frequencies to be received simultaneously due to the various path lengths that are available within the fractal design. However, although these fractal antennas are broadband, their reception of each individual frequency is poor since the signal current is spread over multiple frequencies at once.

Antenna with Frequency-Selective Leg Elements

Antennas of the present embodiments involve a single antenna that has a modifiable antenna path length such that the resonant frequency of the antenna can be adjusted. For example, the resonant frequency can be dynamically changed according to which frequency in the ambient environment has the strongest signal at that time. Thus, the present antennas enable power optimization in energy harvesting.

The present antennas have a plurality of leg elements that form a continuous path, where one or more leg elements can be de-selected—that is, not active during operation of the antenna at a desired resonant frequency. The antenna gathers energy at only the specific resonant frequency in contrast to, for example, fractal antennas that receive many frequencies simultaneously. Since only one frequency is harvested, the antenna performs with high efficiency. If a different frequency is desired to be targeted for energy harvesting, such as if a first signal that was harvested is no longer available but a second signal has increased in strength, the antenna can be adjusted to have a different antenna path length corresponding to the frequency of the second signal.

In general, an antenna's length is set to correspond to the wavelength of the resonant frequency for which it is designed. For example, a standard dipole antenna has two rods, each of which has a length of one-quarter wavelength of the target resonant frequency. The total length of a dipole antenna is one-half wavelength, which results in a standing wave of voltage and current in the rods. The standing wave is caused by a total 360-degree phase change as the current from the feed point of the antenna travels down the quarter-wavelength antenna rod, reflects from the ends of the conductor (i.e., antenna rod), and travels back along the antenna rod to the feed point. Wavelength Δ (in meters) is related to frequency f (in MHz) by the equation:

$$\Delta=300/f \quad \text{(Eq. 2)}$$

Thus, the higher the frequency to be received, the shorter the antenna length. The present embodiments utilize this principle with selectable antenna elements that are enabled by printed leg elements.

Figure 2A:
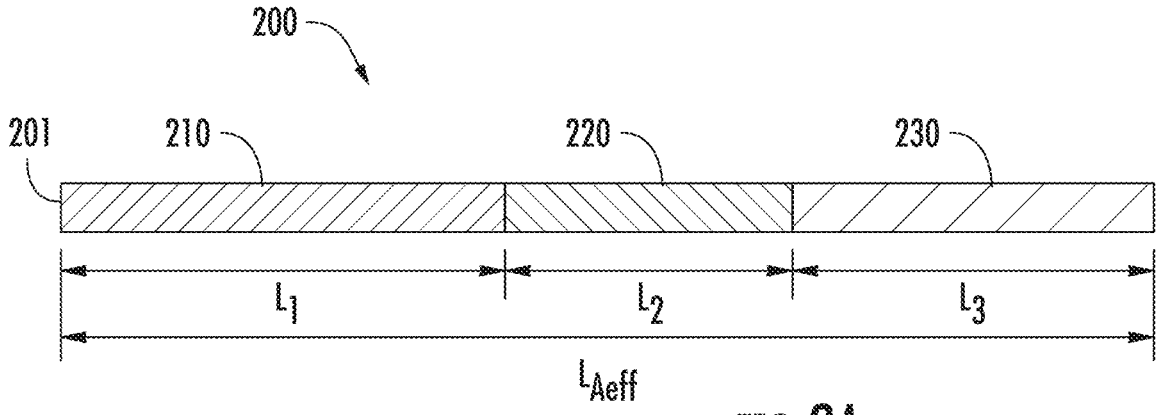
FIGS. 2A-2B are side cross-sectional views of antennas with frequency-selective elements, in accordance with some embodiments.
Figure 2B:
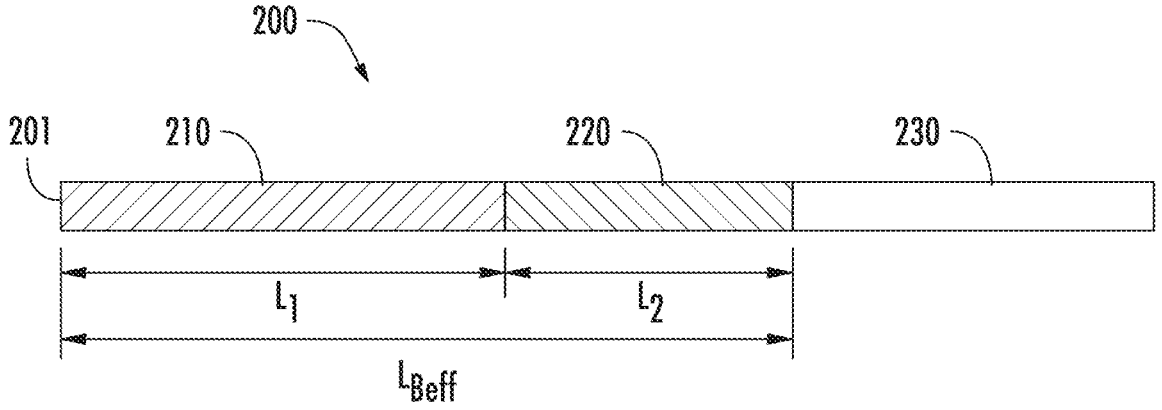

FIGS. 2A-2B are side cross-sectional views of antennas that describe the concept of the frequency-selective elements. In FIGS. 2A-2B, an antenna 200 has multiple leg elements 210, 220 and 230 that together can serve as one arm of a dipole antenna, for example. Note that leg elements may also be referred to leg segments in this disclosure. To form the second arm of the dipole antenna, a ground plane (not shown) is connected at end 201, which is at the end of leg segment 210. Leg segment 210 has a length $L_1$, leg segment 220 has a length $L_2$, and leg segment 230 has a length $L_3$. The lengths $L_1$, $L_2$ and $L_3$ are illustrated as all being different from each other in this embodiment, but in other embodiments the lengths may be all the same or may be a combination of same and different lengths. Also, although the antenna 200 is depicted as linear, the antenna 200 may be any shape such as, but not limited to, curved, spiral or having angled bends.

In FIG. 2A, all of the leg elements 210, 220 and 230 are active such that the antenna path length is $L_{Aeff}=L_1+L_2+L_3$. In FIG. 2B, element 230 has been de-selected, such that the antenna path length is decreased to be $L_{Beff}=L_1+L_2$, which is shorter than $L_{Aeff}$. Since frequency is inversely related to wavelength per Eq. 2 and $L_{Aeff}>L_{Beff}$, the antenna operating in the mode of FIG. 2A with all elements active will resonate at a lower frequency than the same antenna in the mode of FIG. 2B with the leg element 230 being non-active. Thus, FIGS. 2A-2B demonstrate that varying the active length of an antenna arm by utilizing different combinations of one or more leg elements within the arm shifts the resonant frequency of the antenna.

In any of the embodiments disclosed herein, the concepts may be utilized in combination with tailoring the dimensions of an antenna element to further customize the frequency response. For example, the width of a leg element can be tapered along its length.

The present embodiments disclose an antenna system having a substrate and antenna on the substrate, where the antenna has a plurality of leg elements. The plurality of leg elements comprises a conductive ink (i.e., are printed from a conductive material) and forms a continuous path. At least one of the plurality of leg elements is individually selectable or de-selectable to change a resonant frequency of the antenna, and leg elements that are selected create an antenna path length corresponding to the resonant frequency. The resonant frequency may be changed by decreasing the antenna path length due to a de-selected leg element in the plurality of leg elements being inactive. In some embodiments, the conductive ink is carbon-based, and the substrate comprises paper. In some embodiments, the antenna is an energy harvester.

Frequency-Selective Materials Tuning

In some embodiments, the leg elements are selected or de-selected by tailoring the materials of the leg elements, which affects the electrical impedances and consequently the frequency response of the leg elements.

Impedance describes how difficult it is for an alternating current to flow through an element. In the frequency domain, impedance is a complex number having a real component and an imaginary component due to the antenna behaving as an inductor. The imaginary component is an inductive reactance component $X_L$, which is based on the frequency f and the inductance L of the antenna:

$$X_L=2\pi fL \quad \text{(Eq. 3)}$$

As the received frequency increases, the reactance also increases such that at a certain frequency threshold the element will no longer be active (when the impedance of the element goes above, for example, 100 Ohms). The inductance L is affected by the electrical impedance Z of a material, where Z is related to the material properties of permeability μ and permittivity c by the relationship:

$$Z=\sqrt{\frac{\mu'+j\mu''}{\varepsilon'+j\varepsilon''}}=\sqrt{\frac{\mu_0}{\varepsilon_0}}, \quad \text{(Eq. 4)}$$

Thus, tuning of the antenna's material properties changes the electrical impedance Z, which affects the inductance L and consequently affects the reactance $X_L$.

The present embodiments uniquely recognize that leg elements with different inductances will have different frequency responses. That is, an antenna element with a high inductance L (being based on electrical impedance Z) will reach a certain reactance at a lower frequency than another antenna element with a lower inductance. From Eq. 3, the impedance is low at lower frequencies (e.g., 20 MHz to 100 GHz) compared to higher frequencies. Antenna leg elements with lower impedance than higher impedance leg elements will be active and are utilized to increase the antenna's path length to fit the resonance for the desired frequency (per Eq. 2). As frequency increases the element's impedance increases and becomes non-active—that is, ignored—at a certain resonant frequency threshold to effectively shrink the antenna's path length, changing the frequency of resonance. The selecting or de-selecting of leg elements based on frequency response occurs passively due to the nature of the material itself, without the need for electronic control. This novel concept of frequency-selective materials tuning is used to affect optimal resonant tuning of the antenna, by adjusting the antenna path length created by active elements. In some embodiments, the antenna's response can also be influenced by the electrical conductivity $\sigma$ of the antenna material.

The present embodiments utilize these material properties of permeability, permittivity and conductivity to design each leg element with a particular electrical impedance to result in a particular resonant frequency threshold. In other words, tuning of antenna materials is used to create broadband antenna elements for maximized energy harvesting and power transmission performance. The resulting "meta-antenna" can be finely tuned in small increments to various frequencies such as in the megahertz to gigahertz range, only as limited by physical limits of antenna lengths that can fit on the substrate. By designing the frequency response of the leg elements into the material of the antenna, the antenna uniquely has leg elements are passively selectable or de-selectable. That is, no electronic circuit such as a microprocessor is required to change the path length of the antenna. Instead, certain leg elements will naturally turn on or off at certain frequencies for which they are designed.

Figure 3A:
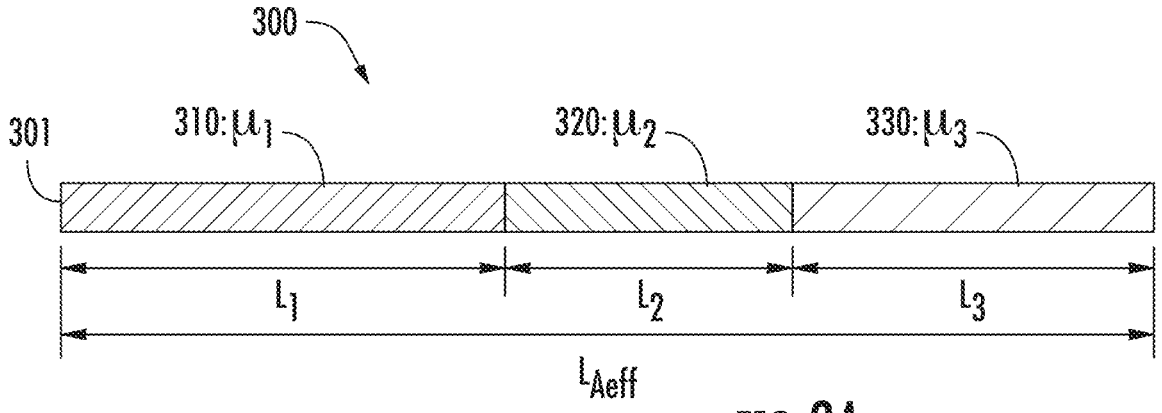
FIGS. 3A-3B are side cross-sectional views illustrating the use of materials tuning to select or de-select leg elements of an antenna, in accordance with some embodiments.
Figure 3B:
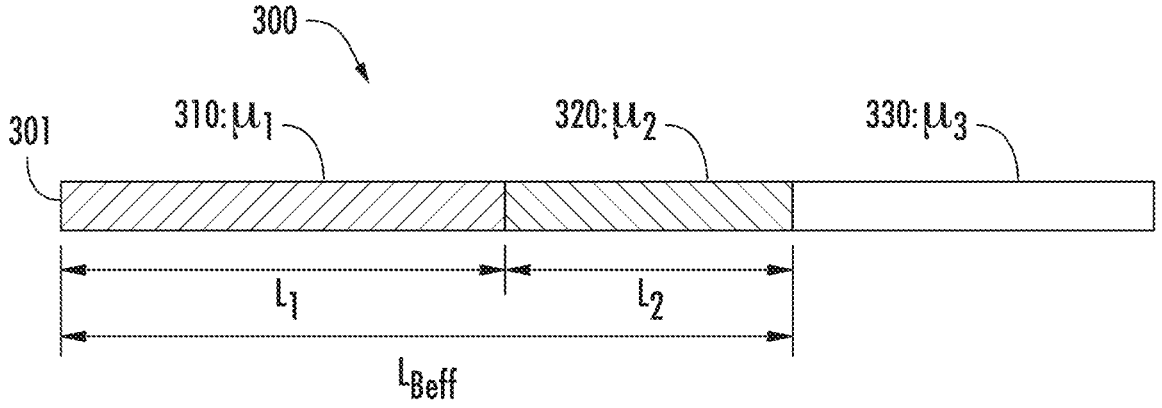

FIGS. 3A-3B are side cross-sectional views illustrating embodiments of using materials tuning to select or de-select leg elements of an antenna. Similar to antenna 200 of FIGS. 2A-2B, antenna 300 of FIGS. 3A-3B has multiple leg segments 310, 320 and 330. Leg segments 310, 320 and 330 can form one arm of an antenna while a second arm (e.g., a ground plane) is connected at end 301, at the end of leg segment 310. Leg segment 310 has a length $L_1$ and permeability $\mu_1$, leg segment 320 has a length $L_2$ and permeability $\mu_2$, and leg segment 330 has a length $L_3$ and permeability $\mu_3$. The lengths $L_1$, $L_2$ and $L_3$ are illustrated as all being different from each other in this embodiment, but in other embodiments the lengths may be all the same, or may be a combination of same and different lengths. Also, although the antenna 300 is depicted as linear, other shapes may be used such as, but not limited to, curved, spiral or angled.

The permeability along the length of the antenna 300 is graded where permeability increases away from the ground plane (at end 301), such that $\mu_1$ is less than $\mu_2$ which is less than $\mu_3$. Since permeability is proportional to electrical impedance, which impacts inductance and consequently the frequency response, the leg elements 330 and then 320 will be de-selected as frequency is increased, consequently decreasing the path length of the antenna 300. In other words, for each leg element 320 and 330 there is a corresponding resonant frequency threshold above which the frequency response of the leg element 320 or 330 results in the leg element 320 or 330 not conducting at a level sufficient for the leg element 320 or 330 to be active and contribute to the antenna 300. Thus, at a received frequency that is above the resonant frequency threshold of the leg element 330 but below the resonant frequency threshold of the leg element 320, the leg element 330 is de-selected by being inactive due to the high level of its resulting impedance, and the leg element 320 is selected by being active due to the lower level of its resulting impedance. Additionally, if the received frequency is at an even higher level above the resonant frequency threshold of the leg element 320, the leg element 320 will also be de-selected by being inactive due to the high level of its resulting impedance.

For example, in FIG. 3A a received frequency of an EM signal is sufficiently low for the resulting impedances of all of the leg elements 310, 320 and 330 to be sufficiently low, such that all of the leg elements 310, 320 and 330 active. That is, the received frequency in FIG. 3A is below the resonant frequency thresholds of leg elements 310, 320 and 330. Consequently, the antenna path length is $L_{Aeff}=L_1+L_2+L_3$ and the antenna has a resonant frequency corresponding to a quarter-wavelength $L_{Aeff}$. FIG. 3B represents a situation where the received frequency is higher than in FIG. 3B, being sufficiently high such that the resulting impedance of the leg element 330 is too high for the leg element to contribute to the antenna 300. Thus, in FIG. 3B the leg element 330 is non-active, where the received frequency is higher than a resonant frequency threshold of leg element 330. The antenna path length is decreased to be $L_{Beff}=L_1+L_2$ only, which is shorter than $L_{Aeff}$. The antenna of FIG. 3B will have a higher resonant frequency than that of FIG. 3A.

FIGS. 3A-3B demonstrate antenna embodiments where a first leg element in the plurality of leg elements has a first resonant frequency threshold that is dependent on a received frequency. The first leg element is passively de-selected from the antenna path length by being inactive when the received frequency is above the first frequency threshold. In some embodiments, a second leg element in the plurality of leg elements has a second resonant frequency threshold that is dependent on the received frequency, the second resonant frequency threshold being higher than the first resonant frequency threshold; and the second leg element is passively selected by resonating when the received frequency is below the second resonant frequency threshold. The second leg element may be passively de-selected in addition to the first leg element when the received frequency is above the second resonant frequency threshold, decreasing the antenna path length. In some embodiments, the first resonant frequency threshold is based on a first electrical impedance of the first leg element; the second resonant frequency threshold is based on a second electrical impedance of the second leg element, the second electrical impedance being different from the first electrical impedance due to a difference in a material property; and the material property is selected from the group consisting of: a permeability, a permittivity, and a conductivity.

In some embodiments, an antenna system includes a substrate and an antenna on the substrate. The antenna has a plurality of leg elements, the plurality of leg elements comprising a conductive ink and forming a continuous path. A first leg element in the plurality of leg elements has a first resonant frequency threshold that is dependent on a received frequency and a first electrical impedance of the first leg element. The first electrical impedance is based on a material property selected from the group consisting of: a permeability, a permittivity, and a conductivity. The first leg element is individually de-selectable to change a resonant frequency of the antenna by changing an antenna path length, the first leg element being passively de-selected from the antenna path length by being inactive when the received frequency is above the first frequency threshold. In certain embodiments, a second leg element in the plurality of leg elements has a second resonant frequency threshold that is dependent on the received frequency and a second electrical impedance of the second leg element; the second resonant frequency threshold is higher than the first resonant frequency threshold due to a difference in the material property compared to the first leg element; and the second leg element is passively selected by resonating when the received frequency is below the second resonant frequency threshold.

Figure 4:
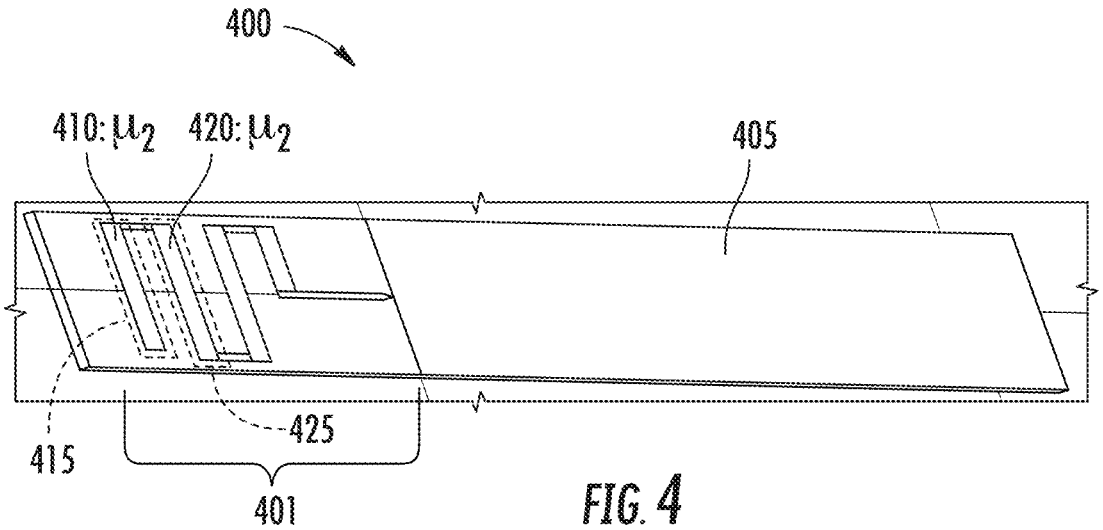
FIG. 4 is a perspective view of a planar inverted-F antenna having leg elements with materials tuning, in accordance with some embodiments.

FIG. 4 is a perspective view of an antenna 400, implementing the concept of materials tuning in a standard planar inverted-F antenna (PIFA) design. The embodiment of antenna 400 has a ground plane 405 and a plurality of leg elements 401 that are segments of the antenna 400. Leg elements 401 include a first leg element 410 and a second leg element 420. First leg element 410 has a permeability $\mu_1$ and second leg segment 420 has a permeability $\mu_2$, where $\mu_1>\mu_2$. Leg element 410 will not be available, as indicated by the dashed box 415, at a received high frequency that is higher than its resonant frequency threshold because the impedance of leg element 410 will be too high. In other words, at a high enough frequency the leg element 410 will not respond and current will reflect at the junction between leg elements 410 and 420. The antenna path length along the path of the "F" shape is thus shortened, increasing the resonant frequency. At even higher frequencies the leg element 420 will also become unavailable as the impedance will be too high, such that the antenna path length along which the current flows is further shortened in length. That is, the areas of dashed boxes 415 and 425 will be de-selected to increase the resonant frequency.

The ability to alter material properties along the length of an antenna is uniquely made possible by printing the antennas. The printing can be performed by, for example, inkjetting, flexographic, or silk-screening methods. In some embodiments, the conductivity of the material is varied along the antenna. In an example of using carbon-based inks, the type of carbon allotrope (e.g., graphene, carbon nano-onions, etc.) can be varied between leg elements, or the conductivity of an allotrope can be varied (e.g., a low-density graphene having a lower conductivity than a more dense graphene). In some embodiments, the permeability of the materials can be changed to affect the frequency thresholds of the leg elements. For example, ferromagnetic materials (e.g., iron oxide) can be used for low frequencies (e.g., 500 kHZ-500 MHZ), paramagnetic materials (e.g., ferrous silicide) can be used for high frequencies (e.g., 500 kHZ-5 GHZ), or anti-ferromagnetic materials can be used. In some embodiments, permittivity, alone or in combination with the conductivity and permeability can be tuned to achieve desired impedance values of the leg elements.

Typically, conventional antenna elements are made of a single type of material with its associated conductivity to affect a specific resonant frequency. In contrast, antenna materials in the present embodiments are printed, where the printing inks can be customized with variable properties within sub-sections of a single antenna to affect the resonant frequency by changing the antenna's path length that is active for that resonant frequency. The customization of material properties can be achieved by modification of the permeability, permittivity and/or conductivity of the legs. This tailoring of the antenna materials can lead to, in the case of enhanced energy reception and transmission, no further change to elements in the antenna and/or matching network.

Frequency-Selective Digital Tuning

Figure 5:
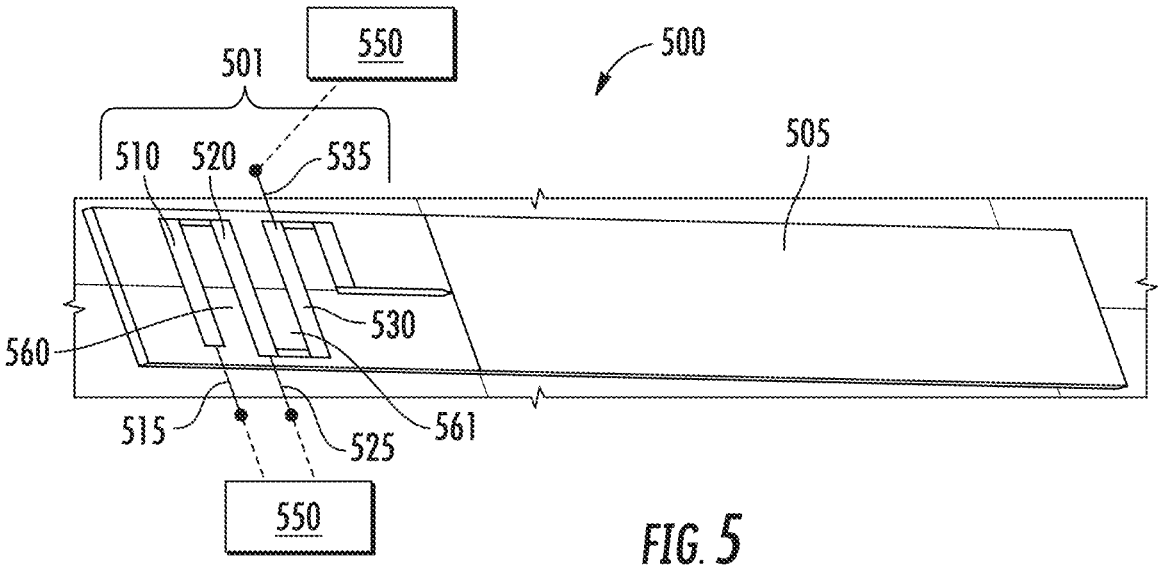
FIG. 5 is a perspective view of a planar inverted-F antenna having leg elements with digital tuning, in accordance with some embodiments.

Besides changing path length by tuning antenna materials to respond to different frequencies, in some embodiments the path length of an antenna can be changed by electronically selecting or de-selecting leg elements. FIG. 5 shows an antenna 500 of a PIFA design similar to FIG. 4, where antenna 500 has a ground plane 505 serving as one antenna arm and a plurality of leg elements 501 serving as a second antenna arm. The plurality of leg elements 501 includes a first leg element 510, a second leg element 520, and a third leg element 530. The leg elements 510, 520 and 530 are parallel segments forming a serpentine pattern with a gap between them, such as gap 560 between leg elements 510 and 520 and gap 561 between leg elements 520 and 530. Electrical connections 515, 525 and 535 are connected to ends of leg elements 510, 520 and 530 respectively, at junctions between the leg elements. Electrical connections 515, 525 and 535 are electrical leads that are electrically coupled to an electronic circuit 550 such as a microprocessor. The electronic circuit 550, which is described in the "Tuning Circuit" section of this disclosure, can short leg elements together to de-select them. For example, connections 515 and 525 can be bridged by the electronic circuit such that leg element 510 is shorted to leg element 520, effectively eliminating (i.e., de-selecting) the presence of leg element 510.

Figure 6A:
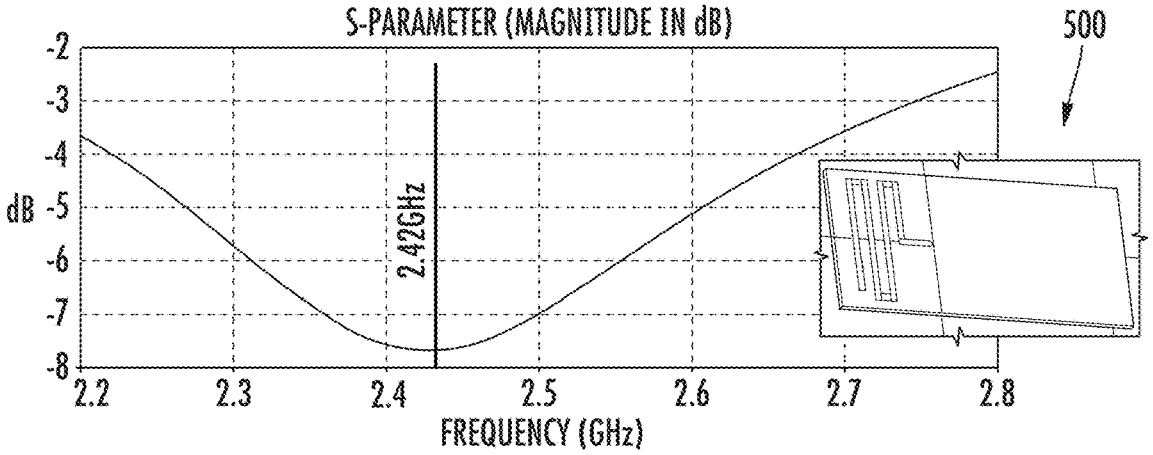
FIGS. 6A-6C show antennas and S-parameter graphs for leg elements with digital tuning, in accordance with some embodiments.
Figure 6B:
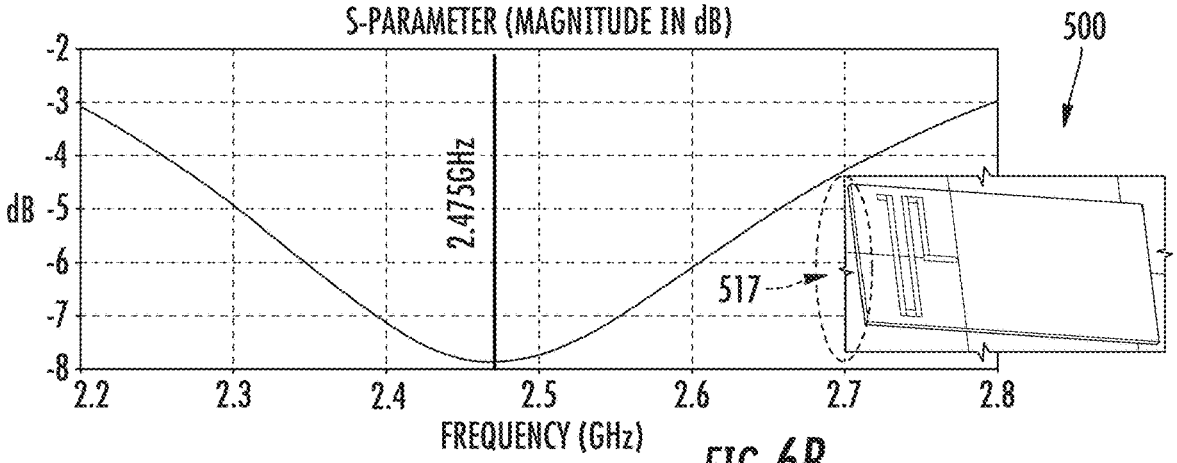
Figure 6C:
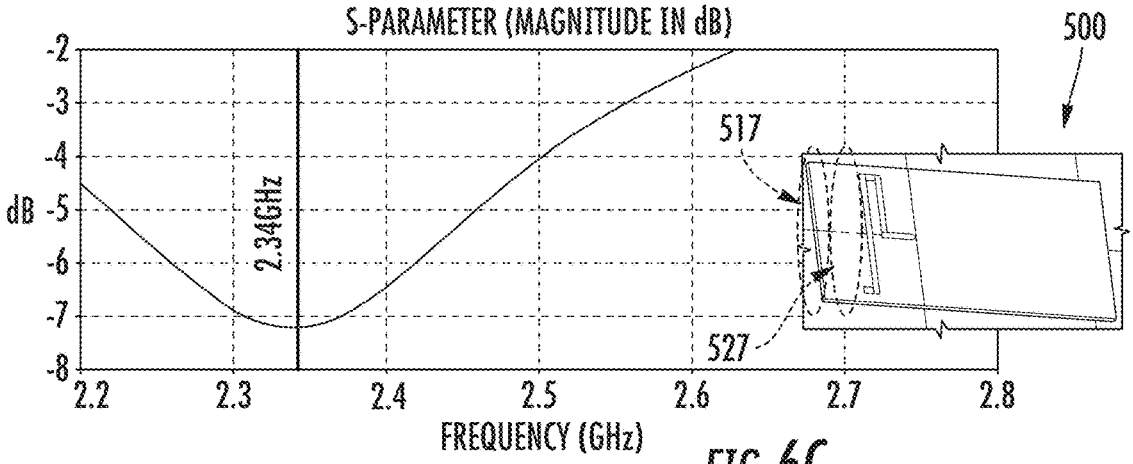

FIGS. 6A-6C show how leg elements can be de-selected by to change the frequency at which antenna 500 resonates. S-parameter (S1,1) graphs are shown for different combinations of the leg elements. In FIG. 6A, the full antenna 500 is used, where all leg elements 501 are selected and active. The resonant frequency is 2.42 GHz in FIG. 6A. In FIG. 6B, leg element 510 has been functionally removed as indicated by blank area 517. This de-selection of leg element 510 is achieved by bridging connections 515 and 525 together using electronic circuit 550, thus shorting leg element 510 to leg element 520. The resulting antenna path length in FIG. 6B is less than the full antenna of FIG. 6A, and consequently the centered frequency shifts higher to 2.475 GHz. In FIG. 6C, leg elements 510 and 520 have both been removed, as indicated by blank areas 517 and 527. The leg elements 510 and 520 have been de-selected by bridging connections 515, 525 and 535 together, thus shorting leg elements 510, 520 and 530 to each other. Although the antenna path length of FIG. 6C is even shorter than FIG. 6A or 6B, the frequency does not increase as would be expected, but shifts lower to 2.34 GHz because of a reduced capacitance due to elimination of parallel leg elements in the F-shaped design (e.g., elimination of the capacitance effect due to gaps 560 and 561). Thus, it can be seen that the geometry (e.g., serpentine, spiral, linear) of the overall antenna can create capacitance effects that can be used in combination with selectable leg elements to tailor an antenna for a desired resonant frequency.

FIGS. 5 and 6A-6C represent embodiments in which an antenna system has an electronic circuit having connections to each of the plurality of leg elements. The electronic circuit is configured to actively de-select a first leg element in the plurality of leg elements by short-circuiting the first leg element to a second leg element in the plurality of leg elements.

In some embodiments, an energy harvesting system includes an antenna system and an electronic circuit. The antenna system includes a substrate and an antenna on the substrate. The antenna has a plurality of leg elements, where the plurality of leg elements comprises a carbon-based conductive ink and forms a continuous path. Each of the plurality of leg elements is individually selectable or de-selectable to change a resonant frequency of the antenna, and leg elements that are selected create an antenna path length corresponding to the resonant frequency. The electronic circuit has connections to each of the plurality of leg elements, where the electronic circuit is configured to actively de-select a first leg element in the plurality of leg elements by short-circuiting the first leg element to a second leg element in the plurality of leg elements.

In some embodiments, the electronic circuit includes an identifying circuit that identifies a plurality of available frequencies in an ambient environment and sets the resonant frequency based on power levels of the plurality of available frequencies; and a switching circuit in communication with the connections to adjust the antenna path length to correspond to the resonant frequency, by selecting or de-selecting leg elements in the plurality of leg elements. In certain embodiments, the identifying circuit comprises a microprocessor that sets the resonant frequency to be a frequency in the plurality of available frequencies that has the highest power level.

Figure 7:
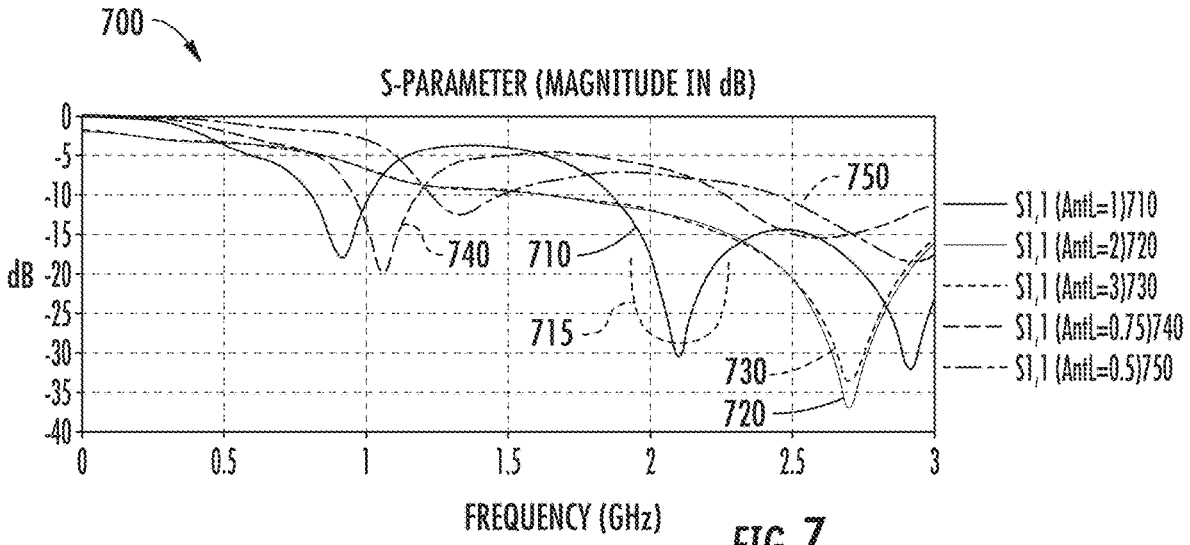
FIG. 7 is an S-parameter graph showing customization of resonant frequencies, in accordance with some embodiments.

In some embodiments, the materials tuning and the electronic switching embodiments can be used in combination. For example, the leg elements of differing permeability in FIG. 4 can also have the electrical lead connections of FIG. 5. Combining the methods can lead to even further customization of the resonant frequency response changes that can be implemented. This is illustrated, for instance, by the S-parameter graph 700 of FIG. 7. The curves represent S(1,1) responses for a linear antenna of different lengths, where curve 710 represents a unit length of 1, curve 720 is for a unit length of 2, curve 730 is for a unit length of 3, curve 740 is for a unit length of 0.75, and curve 750 is for a unit length of 0.5. As can be seen, the resonant frequency peaks are shifted relative to each other due to the differing antenna lengths. Curve 715 illustrates the use of materials tuning in combination with electrical switching, for one resonant peak of curve 710. That is, the narrow resonant peaks of curve 710 become widened when digital tuning is combined with materials tuning. In other words, an antenna length created by electronically de-selecting elements will still result in a particular resonant frequency response, but with a wider band response around those resonant frequencies when materials tuning is used in conjunction. As can be seen, the present antennas can serve as resonators that are formulated to operate at particular frequencies, including at a resonance frequency range around the particular frequencies.

Capacitance Tuning

Figure 8A:
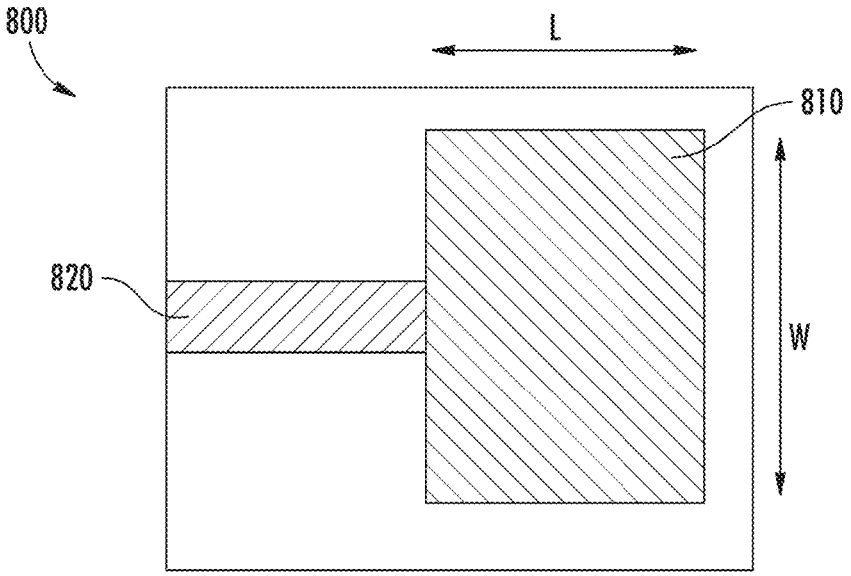
FIGS. 8A-8B show a plan view and a side cross-sectional view of a microstrip antenna into which a dielectric material can printed, in accordance with some embodiments.
Figure 8B:
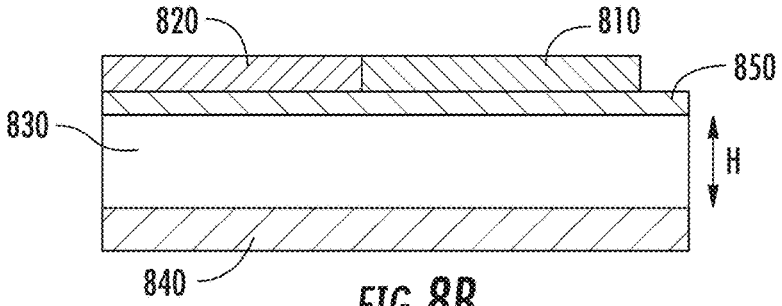

In additional embodiments, a dielectric material can be printed within the antenna structure and/or substrate to change the capacitance of the antenna. For example, a printed dielectric element can be utilized between two leg elements in a plurality of leg elements. This capacitance tuning concept is demonstrated by the microstrip antenna 800 shown in FIGS. 8A and 8B, where FIG. 8A is a plan view and FIG. 8B is a side cross-sectional view. A patch antenna 810 is fed by a microstrip transmission line 820, both of which are mounted on a surface of a substrate 830. A ground plane 840 is mounted on the opposite surface of the substrate 830. The patch antenna 810, microstrip transmission line 820 and ground plane 840 are made of high conductivity metal (typically copper in conventional antennas). The patch antenna 810 has dimensions of a length L and width W. Substrate 830 is a dielectric circuit board of thickness h with permittivity $\varepsilon_r$.

The thickness of the ground plane 840 or of the microstrip formed by antenna 810 and transmission line 820 is not critically important. Typically, the height h is much smaller than the wavelength of operation, but should not be much smaller than 0.025 of a wavelength (1/40th of a wavelength) or the antenna_efficiency will be degraded.

The frequency of operation of the patch antenna 810 is determined by the length L. The center frequency $f_c$ (i.e., resonant frequency) will be approximately given by:

$$f_c \approx \frac{c}{2L\sqrt{\varepsilon_r}} = \frac{1}{2L\sqrt{\varepsilon_0\varepsilon_r\mu_0}} \quad \text{(Eq. 5)}$$

Thus, the resonant frequency of the antenna 800 is affected by the permittivity of the substrate 830. In the embodiment of FIG. 8B, a dielectric layer 850 can be printed on front surface of the substrate 830 (and/or back surface) to change the aggregate permittivity of the substrate 830. In other embodiments, the substrate 830 may be layered, such as a corrugated cardboard structure, where a dielectric element can be printed on any of the outer surfaces of the cardboard and/or within an intermediate layer of the cardboard (e.g., on a corrugated layer). Utilization of a printed dielectric uniquely enables fine tuning of material properties and dimensions to adjust capacitance and ultimately the frequency response of an antenna.

In some embodiments, a printed dielectric element can be utilized between leg elements to customize the frequency response of an antenna. For example, returning to FIG. 5, the gap 560 and/or gap 561 can be created using a printed dielectric ink. Properties of the ink can be customized to create a particular capacitance between the leg elements. Dimensions of the printed dielectric can also be controlled by the printing process.

2D Antennas on Substrates

Examples shall now be provided of antenna designs in which the frequency-selective attributes described above can be implemented with printed antennas on substrates. Planar (2D) antennas shall be described first.

Figure 9:
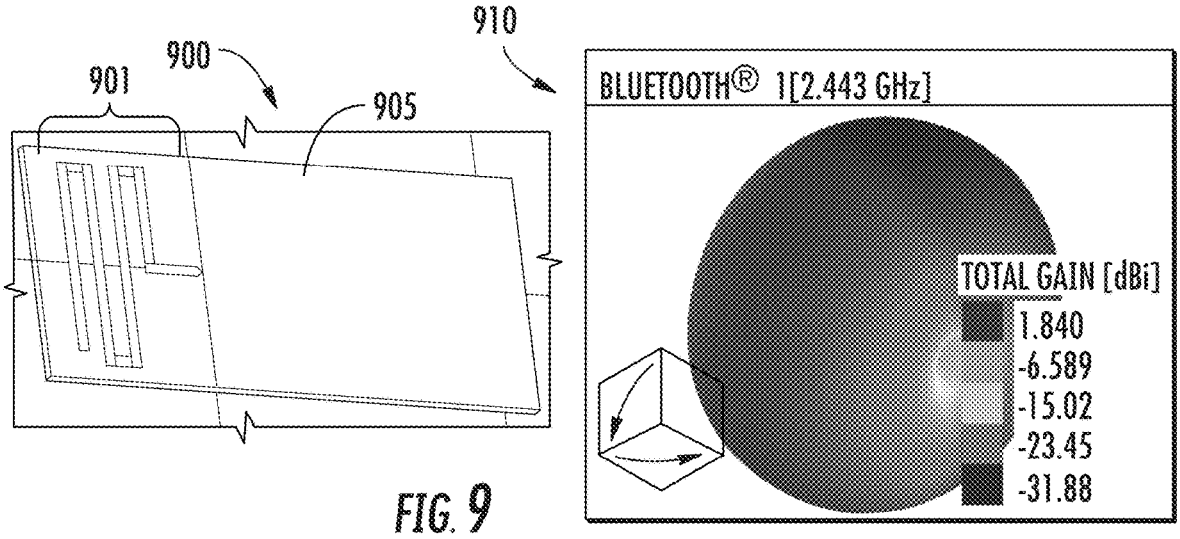
FIG. 9 shows planar inverted-F antenna and antenna gain response, in accordance with some embodiments.

FIG. 9 shows an antenna 900 configured as PIFA design, described previously in relation to FIGS. 4 and 5. The PIFA antenna 900 has an F-shaped antenna 901 serving as one conductor, and a ground plane 905 serving as another conductor in this dipole design. An example antenna gain response 910 (in dBi) for the antenna 900 is modeled at a Bluetooth® frequency of 2.443 GHz, showing a uniform radiation pattern in all directions. In other words, the antenna gain response 910 demonstrates that this antenna 900 has a directionality for reception or transmission that can emit or receive from practically any direction.

Figure 10:
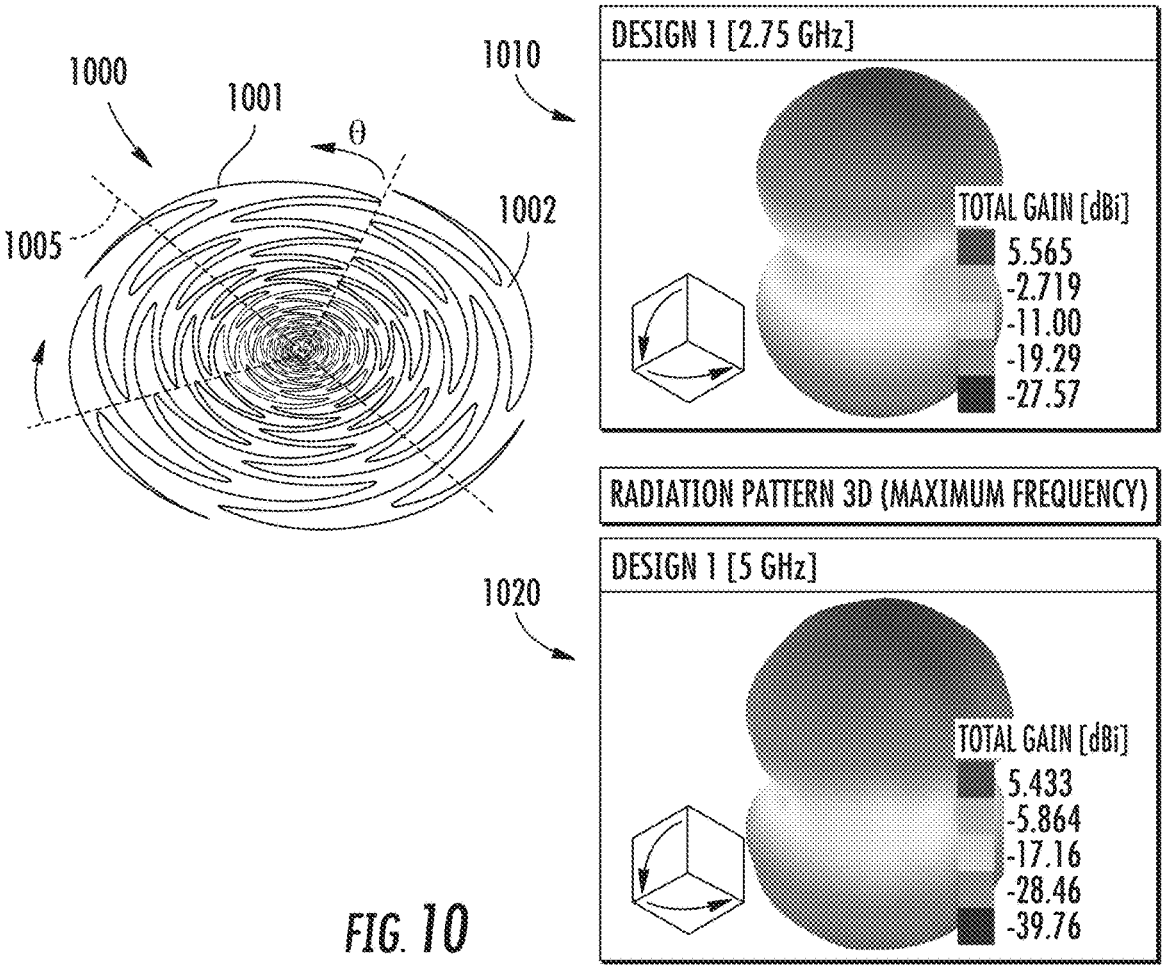
FIG. 10 shows a sinuous antenna and antenna gain response, in accordance with some embodiments.

FIG. 10 shows a sinuous antenna 1000 that has two identical pairs of orthogonal planar arms 1001 and 1002. Each arm 1001 and 1002 can be configured with selectable leg elements as described in the materials tuning, electronically switchable, and/or capacitance tuning embodiments in this disclosure. The edges of each arm 1001 and 1002 are sinuous curves which swing back and forth over a bisecting line 1005 of an angular sector θ with logarithmic radial period. Each arm 1001 and 1002 is an alternating sequence of geometrically similar cells on either side of the bisecting line 1005. The sector angle θ can approach 180 degrees or greater such that the cells of adjacent arms are interleaved but do not touch. The geometry of each arm is fully specified by two angles, the log-periodic growth constant, and the inner and outer radii (described in the known art by DuHamel, and Filipovic & Cencich). High performance sinuous antennas are usually self-complementary and tightly wound to achieve stable radiation patterns and impedance over the operating frequency band. Responses 1010 and 1020 are shown at two designs, with an antenna of resonant frequency 2.75 GHz in response 1010 and a resonant frequency of 5 GHz in response 1020.

Figure 11A:
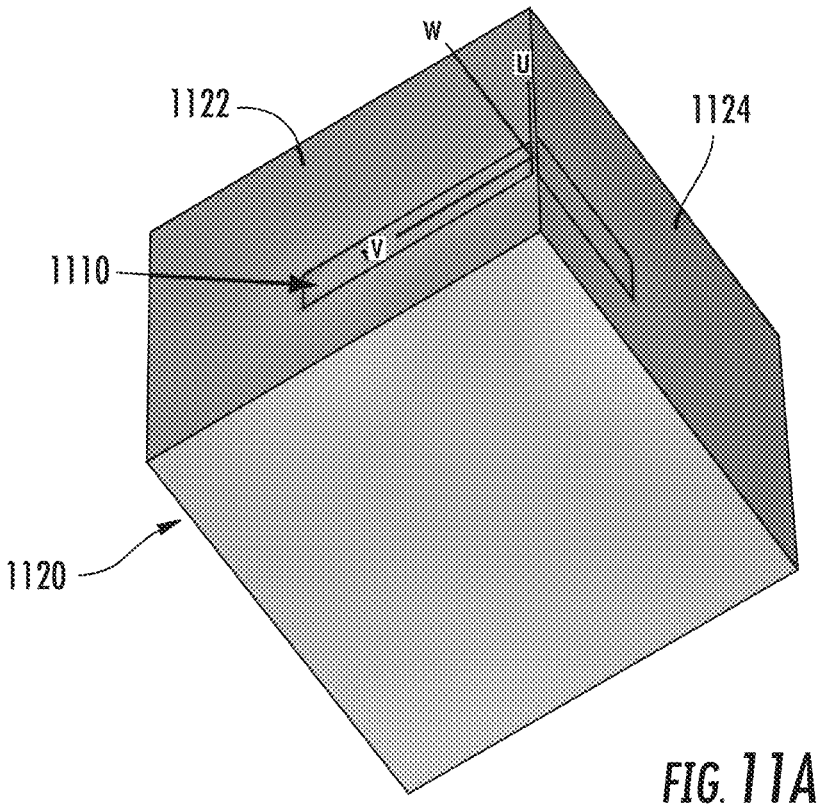
FIGS. 11A-11C illustrate a planar antenna printed on a box, in accordance with some embodiments.
Figure 11B:
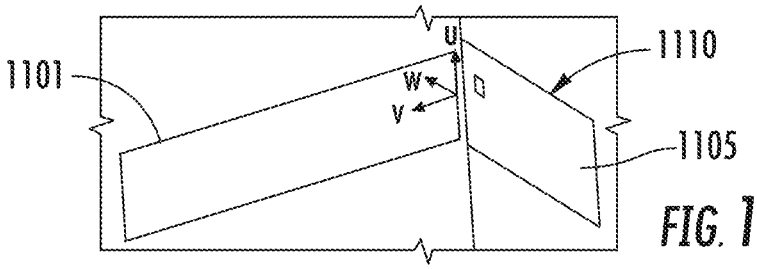
Figure 11C:
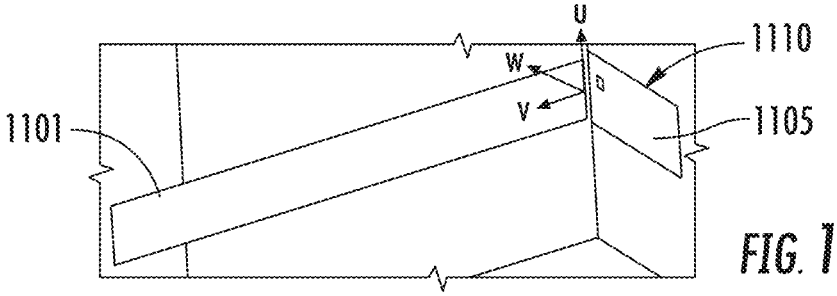

FIGS. 11A-11C illustrate a planar antenna 1110 printed onto two adjacent sides 1122 and 1124 of an object 1120, such as a shipping box. The two antenna arms 1101 and 1105 (i.e., conductors) of the antenna 1110 may be, for example, the ground plane and F-shaped elements of a PIFA design. FIGS. 11B-11C illustrate that the length of the element 1101 can be altered for the desired resonant frequency (e.g., as in the graph of FIG. 7), where in this embodiment the path length of antenna element (arm) 1001 is shorter in FIG. 11B than in FIG. 11C. The change in antenna path length may be achieved by de-selecting leg elements within antenna arm 1101.

Although PIFA and sinuous antenna geometries are known, FIGS. 9 and 10 illustrate that the frequency-selective antenna designs of the present embodiments can be applied to a wide variety of geometries, from simple to complex. Because the present antennas are printed, much more complex geometries are achievable than with conventional antennas. FIGS. 11A-11C demonstrate that the antennas of the present disclosure can be configured in a 3D manner, such as to improve polarization.

3D Antennas on Substrates

The present frequency-selective, printed antennas can also be implemented as 3D structures by integrating the antenna components as electro-active layering onto the surfaces and interlayers of substrates for electromagnetic field reception. In order to increase the reception of conventional antennas, the size, number, and dimensionality of the antennas is improved in the present embodiments. Although some embodiments herein shall describe the substrates in terms of packaging such as corrugated cardboard, other types of multi-layer substrates including paper, glass, and plastics are also included in the scope of this disclosure.

In some embodiments the substrate material itself is a 2D or 3D energy device—not just an antenna printed onto the outside of a substrate as in conventional antennas, but a true 2D/3D energy harvester. The frequency-selective antenna technology of the present disclosure is incorporated within layers of multi-layer materials, including types of packaging such as corrugated boxes. The present antenna technology utilizes conductive and dielectric materials for the purposes of RF reception for telemetry and energy harvesting to power RFID and advanced electronics. The antennas can be used, for example, for energy harvesting or communications, such as providing RF energy harvesting function for 915 MHz or 2.45 GHz, or other appropriate or available electromagnetic energy sources.

It is known that 3D features can be added to 2D antennas, such as by bending antenna components, to increase antenna reception. However, bent materials typically yield higher losses due to resistance degradation, as the antenna's input impedance is changed when distorted by bending.

In the present embodiments, resistance degradation in a bent antenna material is mitigated, such that the bending of a structure yields a 3D effect that can be tailored to improve the impedance of the entire matching antenna, increasing total performance. Using layers of 3D substrates, such as cardboard, as conductors and dielectrics to form resonant cavities allows not only high reception performance but multiple frequencies. With the resulting increase in performance via the 3D structure, the resistance limitations can be relaxed in the construction of the design.

Figure 12A:
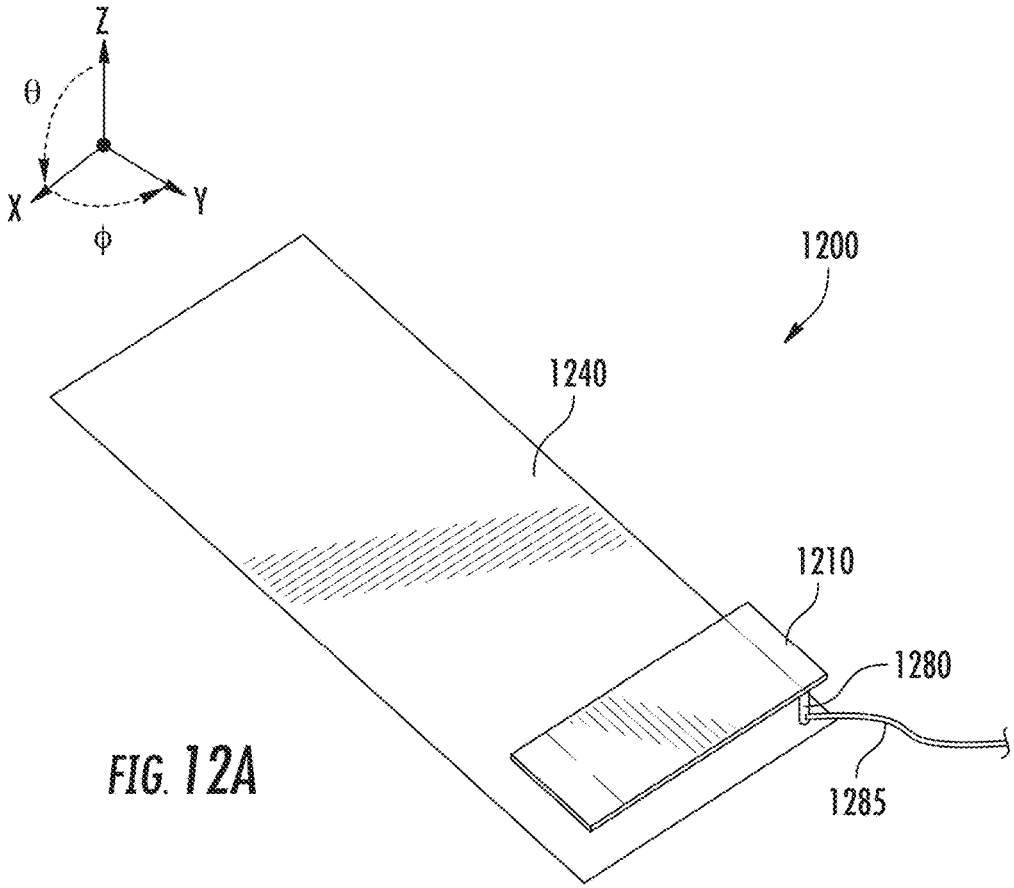
FIGS. 12A-12B show perspective and side cross-sectional views of a folded inverted-F antenna incorporated into a three-dimensional substrate, in accordance with some embodiments.
Figure 12B:
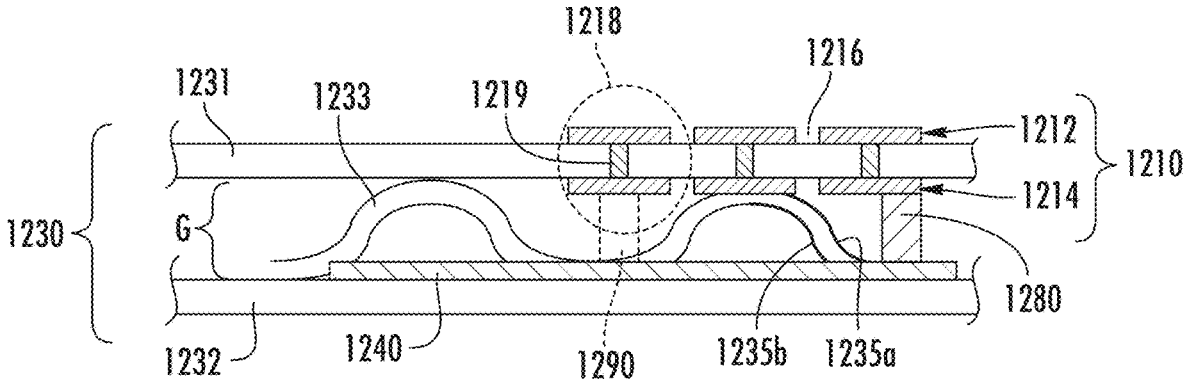

FIG. 12A is a perspective view of a folded inverted-F antenna 1200 (FIFA) but implemented as a 3D structure that can be integrated into a substrate. FIG. 12B is a partial side cross-sectional view. The antenna arm 1210 is a radiating element that can be configured with frequency-selective elements as described previously. The antenna arm 1210 is fabricated from a top metallization layer 1212 and a bottom metallization layer 1214 on a first layer 1231 of a substrate 1230 (note, substrate 1230 is not shown in FIG. 12A for clarity). Slots 1216 are etched out from both metallization layers 1212 and 1214, separating antenna arm 1210 into sub-patches 1218. Two slots 1216 in each layer 1212 and 1214 forming three sub-patches 1218 are shown in FIG. 12B for simplicity, but other configurations are possible (e.g., five sub-patches or any appropriate number thereof). Vias 1219 connect the metallization layers 1212 and 1214. In order for the antenna to operate correctly, the antenna arm 1210 is mounted a specific height above a ground plane 1240, supported by a feed pin 1280 and a shorting pin 1290 connecting the top and bottom metallization layers 1212 and 1214 of the radiating antenna element 1210 and continuing down to the ground plane 1240. Ground plane 1240 is shown on an inner surface of second layer 1232 of substrate 1230 in FIG. 12B but could also be on the outer surface (i.e., the exterior surface of second layer 1232). In operation, a lead wire 1285 provides electrical connection to feed pin 1280 to collect an output signal from the antenna 1200.

In FIG. 12B, the substrate 1230 is a 3D structure embodied as a corrugated medium. For example, first layer 1231 can be a first linerboard and second layer 1232 can be a second linerboard stacked on first layer 1231, with an intermediate layer 1233 in the gap G between the first layer 1231 and the second layer 1232. Intermediate layer 1233 is illustrated in this embodiment as a fluted, corrugated layer. In the design of the substrate 1230, gap G can be customized according to the desired height between the antenna arm 1210 and ground plane 1240. In further embodiments, a printed dielectric component can be inserted within the gap G to tailor an aggregate capacitance of the antenna 1200, such as on any surfaces of first layer 1231, second layer 1232, and intermediate layer 1233 that are within the gap G. In some embodiments, parts of the intermediate layer 1233 can be printed with a conductive material so that electrical connections can be made to an electronic circuit to select and de-select leg elements. Examples of these printed conductive elements 1235*a* and 1235*b* are shown on an upper surface and lower surface, respectively, of the intermediate layer 1233.

In some embodiments, the ground plane 1240 can be used as a shielding element. For example, if substrate 1230 is a corrugated cardboard that is made into a shipping container, the substrate 1230 can be oriented such that the second linerboard 1232 is on the exterior of the box. Any portions of the container that have the ground plane 1240 covering it will have electromagnetic shielding for contents inside the container. Note that the ground plane 1240 may be either on the inner surface of the second linerboard 1232 as shown in FIG. 12B, or on the outer surface of second linerboard 1232 (exterior of the second linerboard 1232).

Figure 13:
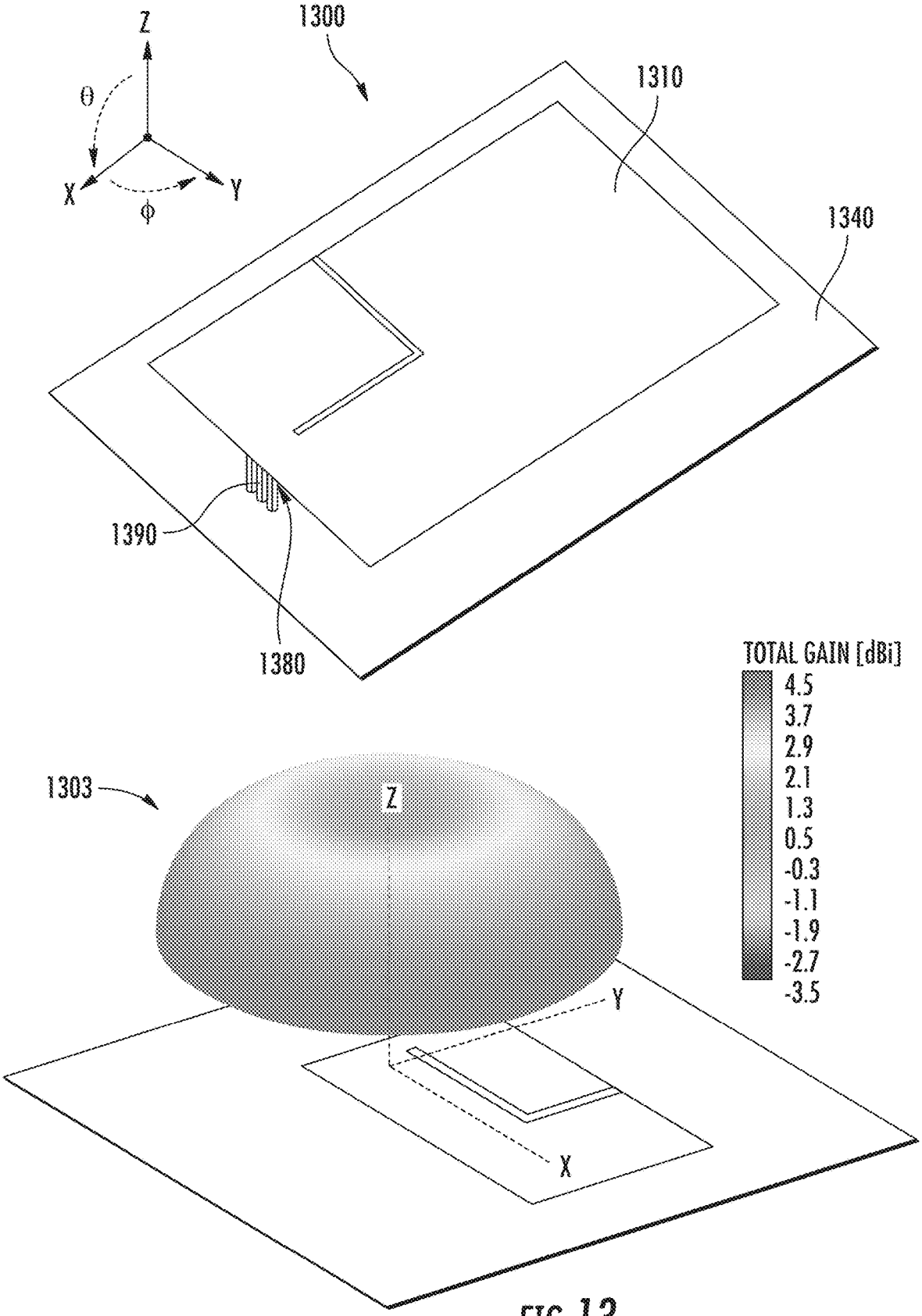
FIG. 13 shows a perspective view of an L-slot dual-band planar inverted-F antenna, in accordance with some embodiments.

FIG. 13 shows a perspective view of an L-slot dual-band planar inverted-F antenna (PIFA) 1300. The antenna 1300 includes a rectangular planar element serving as an antenna arm 1310, a ground plane 1340, a feed pin 1380 and a short-circuit plate 1390. The short-circuit plate 1390 is embodied in FIG. 13 as multiple short-circuit pins. The short-circuit plate 1390 between the planar element (antenna arm 1310) and the ground plane 1340 is typically narrower than the side of the planar element that is being short-circuited. The L-slot PIFA-style antenna arm 1310 can have frequency-selective leg elements incorporated into it to enable the antenna 1300 to have adjustable resonant frequencies. Also, the antenna 1300 can be integrated into a 3D substrate in a similar fashion as described in relation to FIGS. 12A and 12B. FIG. 13 also shows an antenna gain response 1303, in which the antenna 1300 has uniform radiation in a radial direction in a plane parallel to the ground plate 1340.

Figure 14:
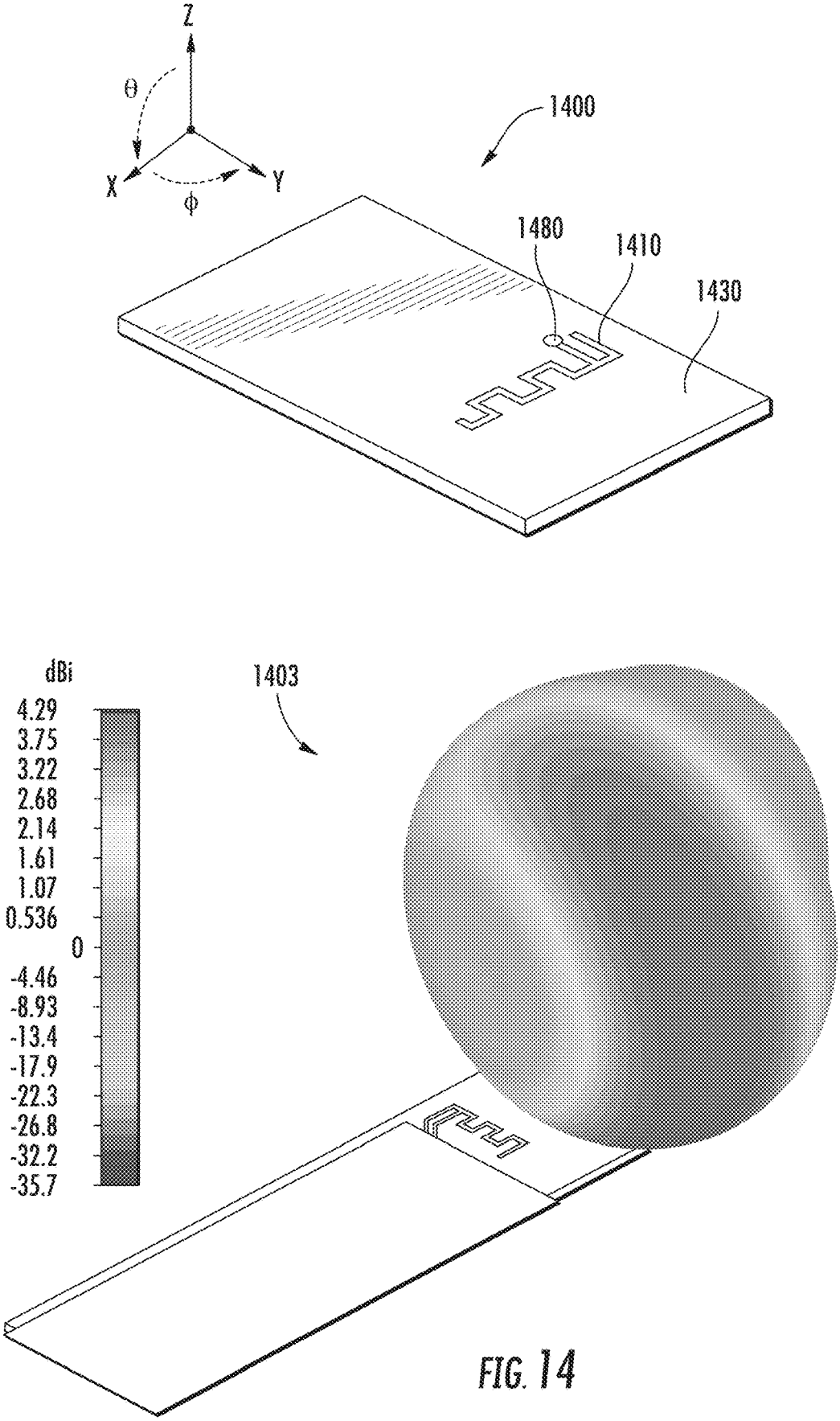
FIG. 14 shows a perspective view of a printed meandered inverted-F antenna, in accordance with some embodiments.

FIG. 14 is a perspective view of a printed meandered inverted-F antenna 1400. The antenna 1400 has etched metal lines above a dielectric 1430, forming a meandered inverted F-shape antenna arm 1410. An outside prong of the F is shorted by feed pin 1480 to the edge of the ground plane (not seen in this view) which is located on the back surface of the dielectric 1430. The ground plane covers one section of the dielectric, namely that which does not fall directly beneath the meandered inverted F arm 1410. The antenna arm 1410 is fed with respect to the edge of the ground plane at the second prong, by feed pin 1480. The meandered inverted-F style of antenna arm 1410 can have frequency-selective leg elements incorporated into it to enable the antenna 1400 to have adjustable resonant frequencies. Also, the antenna 1400 can be integrated into a 3D substrate in a similar fashion as described in relation to FIGS. 12A and 12B. FIG. 14 also shows an antenna gain response 1403, in which the antenna 1400 has uniform radiation in a radial direction in a plane parallel to the ground plate 1340.

Figure 15:
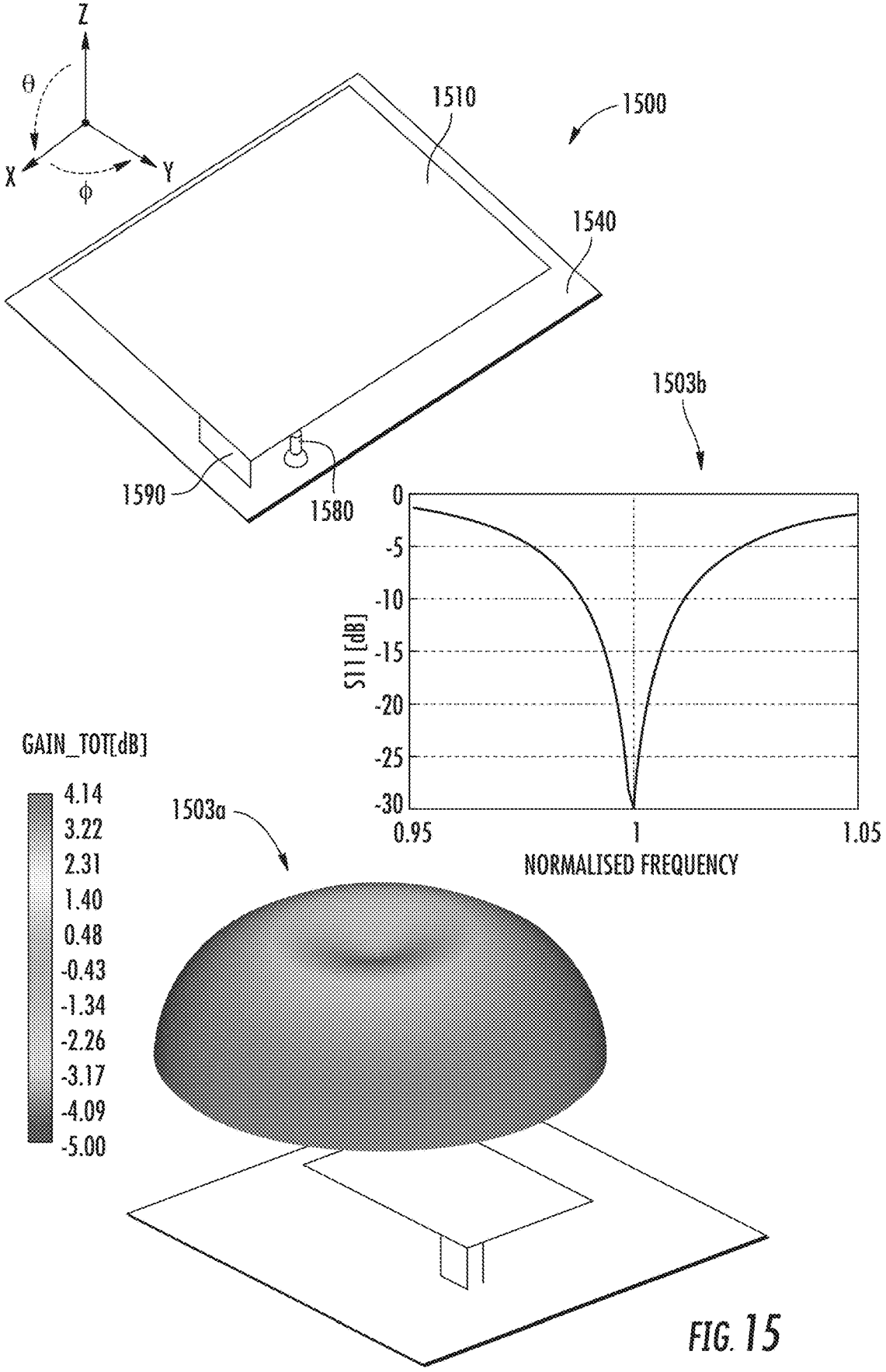
FIG. 15 shows a perspective view of another planar inverted-F antenna, in accordance with some embodiments.

FIG. 15 shows a perspective view of another planar inverted-F antenna 1500, where this PIFA style is yet another example of a design into which frequency-selective leg elements can be incorporated as a 3D structure. The antenna 1500 typically has a rectangular planar element serving as an antenna arm 1510, a ground plane 1540, and a short-circuit plate 1590 of narrower width than that of the shortened side of the planar element. A feed pin 1580 is also shown, which serves as a feed point for a frequency signal that is received by the antenna 1500. Antenna gain response 1503*a* is shown, with graph 1503*b* being a corresponding S(1,1) response plot.

Figure 16:
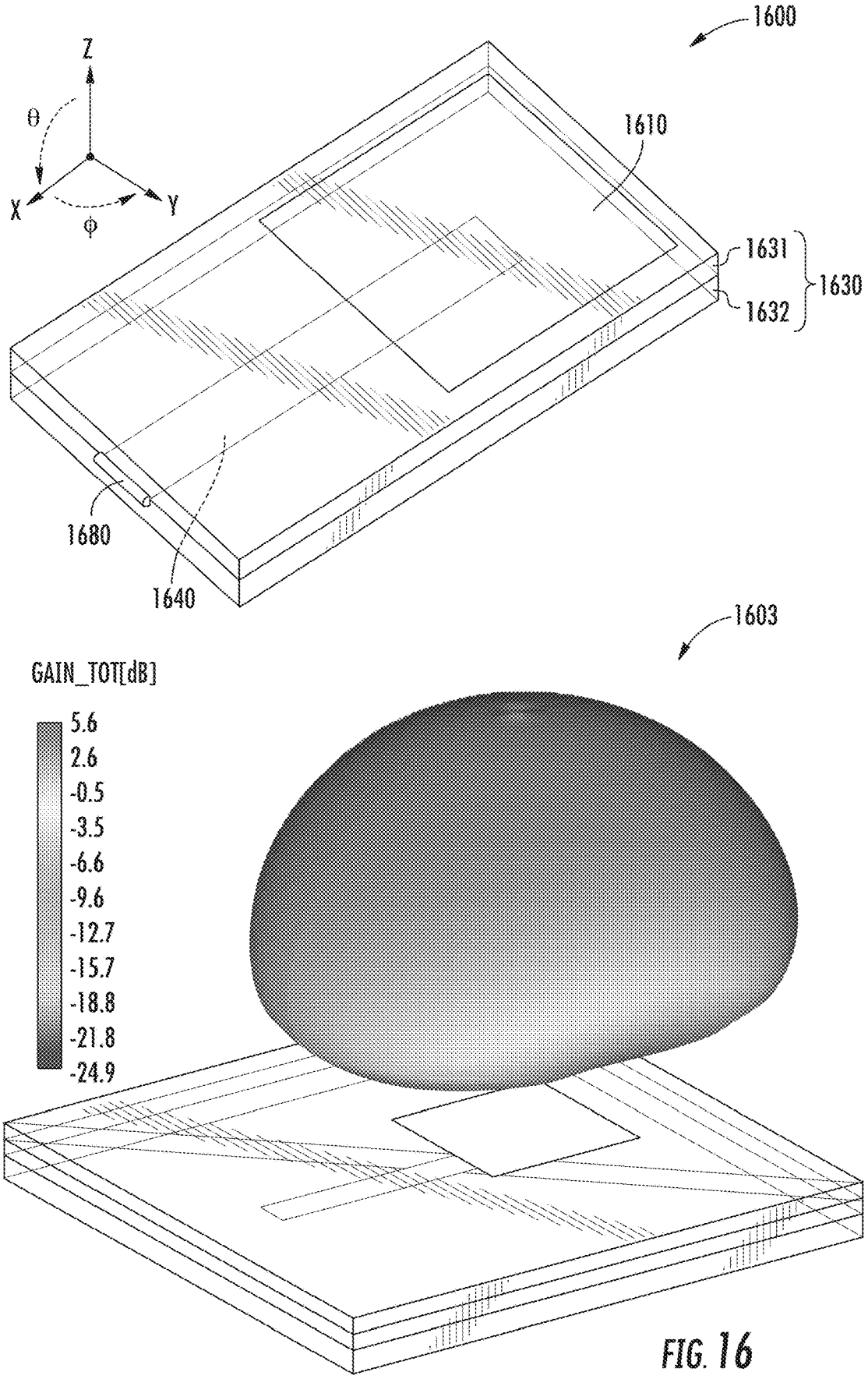
FIG. 16 shows a perspective view of a rectangular electromagnetically coupled patch antenna, in accordance with some embodiments.

FIG. 16 shows a perspective view of a rectangular electromagnetically coupled patch antenna 1600. The EM-coupled patch antenna 1600 has a patch element 1610 and a feed line 1680 which are electromagnetically coupled. Patch element 1610 is positioned on top of an upper dielectric 1631 of a two-dielectric substrate 1630 that also includes lower dielectric 1632. Feed line 1680 is between the upper and lower dielectric substrates 1631 and 1632 and extends underneath the patch 1610. Bandwidth is improved by having the patch element 1610 on top of the thick substrate 1630 (the two-dielectric structure being thicker than a single layer), while spurious radiation is limited by having the feed line 1680 positioned closer to the ground-plane 1640, which is on the back surface of dielectric 1632. Frequency-selective leg elements can be incorporated into the patch element 1610, and the entire antenna 1600 can be constructed as a 3D structure integrated into a substrate material. Antenna gain response 1603 is also shown.

FIGS. 12A/B through FIG. 16 are examples of known types of antennas into which the frequency-selective leg elements of the present disclosure can be incorporated as 3D structures. In some embodiments, the 3D structures are implemented into a multi-layer substrate, such as a corrugated medium. Examples of corrugated structures that may be used include single face, single wall, double wall and triple wall. Single layer, double layer, or even more layers could be added to become a high reception antenna system. The individually deposited layers on the components of the substrate can be laminated or glued into the final structure. In some embodiments, the bonding agent used to adhere the substrate layers together can also be utilized to tailor the frequency response of the antenna, by altering an aggregate capacitance of the antenna such as by the use of a printed dielectric within the intermediate layer.

In some embodiments, such as represented by FIG. 12B, a substrate for an antenna includes a first layer, a second layer stacked on the first layer, and an intermediate layer in a gap between the first layer and the second layer. A plurality of leg elements is on the first layer, the plurality of leg elements forming a first antenna arm of the antenna. The antenna further includes a second antenna arm (e.g., a ground plane for a dipole antenna) on the second layer; and a conductor (e.g., conductive elements 1235*a* and 1235*b*) on the intermediate layer, the conductor electrically coupling the second antenna arm to the plurality of leg elements. In certain embodiments, the multi-layer substrate can be cardboard, where the intermediate layer is a corrugated medium. In some embodiments, a gap between the first and second layers of the substrate serves as a dielectric between the first antenna arm and the second antenna arm. In some embodiments, characteristics of the gap can be customized to impact antenna behavior. For example, the gap distance and properties of the materials in the gap (e.g., air, the substrate material for the intermediate layer, and dielectrics inserted into the gap) can change capacitance effects of the antenna and consequently the antenna's frequency response.

Various types of 3D features may be utilized in a substrate, such as a fluted configuration (a wave pattern in an x-y plane extending in a z-direction orthogonal to the plane of the wave) that is in typical corrugated mediums. However, other 3D features are possible, such as waves in x, y and z-directions, or various types of wave patterns. In general, the 3D features used in embodiments of the present disclosure should have curved transitions, as sharp edges will cause discontinuities in the electrical paths within the antennas. In some embodiments, the 3D features of the substrate can be designed to also contribute to the resonant frequency of the antenna. For example, when the intermediate layer has electrical conducting lines printed onto it to serve as electrical connections to a switching circuit, the period of the corrugations can be designed according to the resonant frequencies that are desired to be harvested or transmitted.

Using packaging materials as an example, the integration of the present antennas into a packaging container enables a significant increase in functionality for energy harvesting. As a sample configuration, for a small box with 1 $ft^2$ sides where 80% of the area has antenna material incorporated, the packaging container could produce on the order of 0.5-1 milliamps at approximately 2.6 volts. Using a storage device like a low-cost supercapacitor, this amount of current can power significantly more functions (including memory) than conventional energy harvesting devices. An example of an application of the improved functionality is logging the temperature of the package during shipment.

Manufacturing of 3D Printed Antennas

Figure 17:
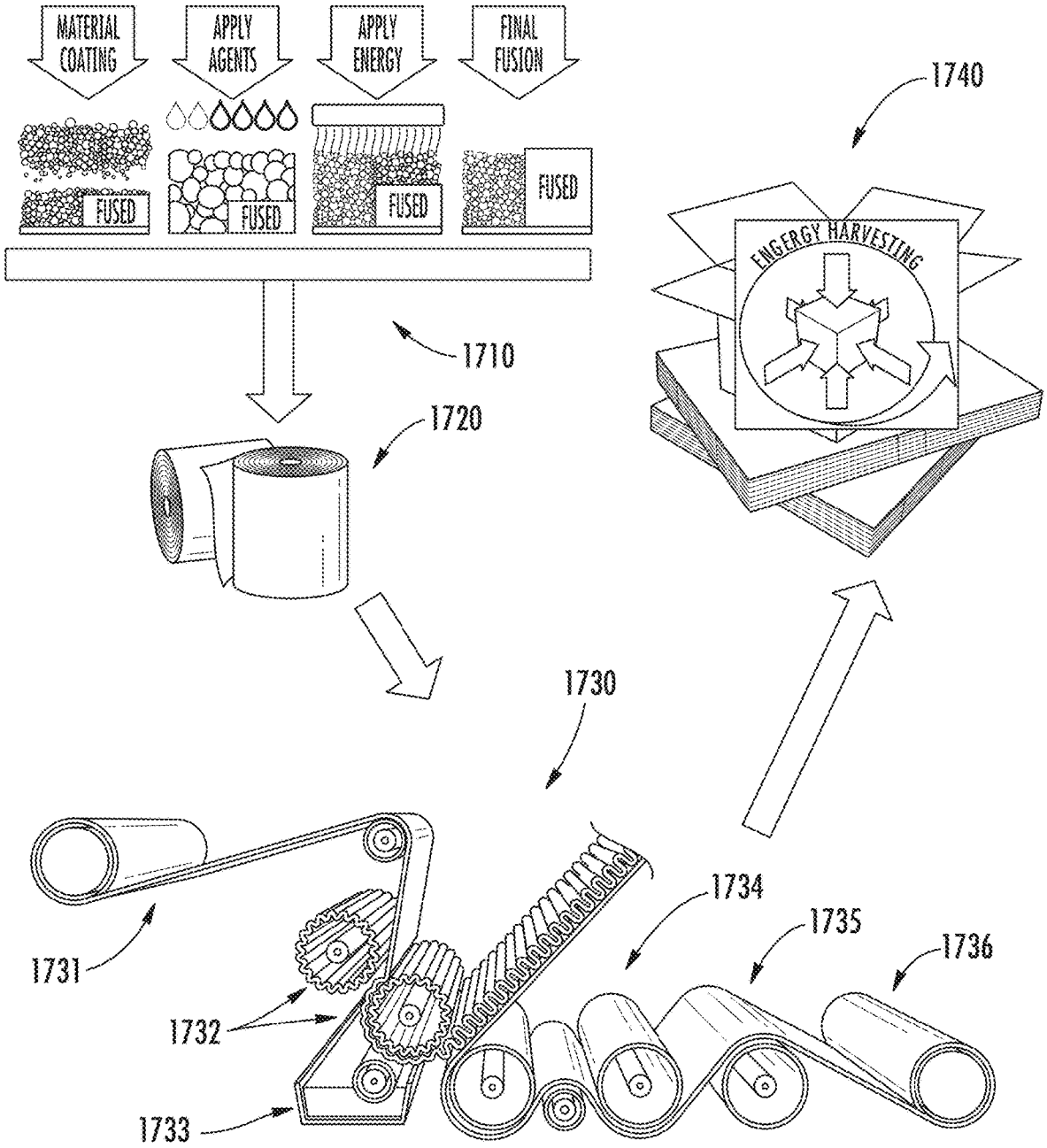
FIG. 17 illustrates a schematic of a process for manufacturing a printed, frequency-selective antenna, in accordance with some embodiments.
Figure 18:
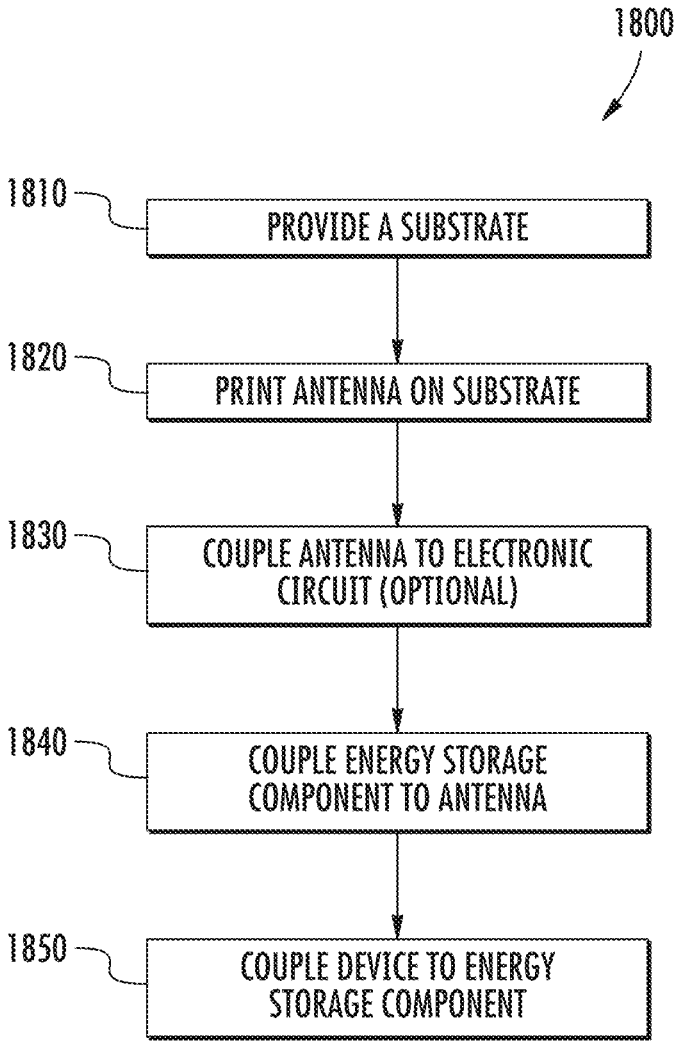
FIG. 18 is a flowchart of a method for manufacturing a printed, frequency-selective antenna system, in accordance with some embodiments.

FIG. 17 illustrates a schematic of an example process for manufacturing a printed, frequency-selective antenna. The schematic of FIG. 17 illustrates a 3D antenna packaging material, although the process also applies to 2D (e.g., single-layer) substrates. FIG. 18 is a corresponding flowchart. In some embodiments of FIGS. 17 and 18, an energy harvesting device includes a printed packaging material where an electrically conductive material is printed onto a packaging material sheet. The printed packaging material is formed into a packaging container.

In the example of FIG. 17, the substrate material is card stock 1720, onto which antenna materials are printed, such as by using a multi jet fusion process 1710. In the embodiment of FIG. 17, the printed card stock is corrugated, and layers of the final structure are assembled in process 1730, such as by gluing. Process 1730 shows a first liner 1731, corrugated rollers 1732, a glue applicator 1733, pressure rollers 1734, heater rollers 1735, and a second liner 1736. The first liner 1731 corresponds to the intermediate layer 1233 of FIG. 12B, and second liner 1736 can be either the first layer 1231 or second layer 1232 of FIG. 12B. Another liner (not shown) is added to form the other liner (second layer 1232 or first layer 1231) of FIG. 12B.

In general embodiments, the printed packaging material can include a plurality of layers, where the assembled layers can have dimensions and material properties that impact the resonant frequency of the antenna, such as by forming a resonant cavity. The resulting packaging 1740 is a 3D energy harvesting device (or transmitting and/or receiving device), such as the corrugated cardboard container shown in FIG. 17. In various embodiments, a planar antenna could be used due to the larger area available, or a multi-layer (3D) device could be used dependent upon application.

In some embodiments, the substrates onto which the antennas are printed are flexible in their natural state at room temperature, such as paper- or plastic-based substrates in the forms of sheets or film. In some embodiments, the substrates can be formed into the desired 3D geometry in one state, such as a heated state for a glass or plastic material, but the substrate becomes solidified and inflexible at room temperature. In various embodiments the substrate can be a low-cost material that is disposable and/or biodegradable, for use in applications such as packaging, labels, tickets, and identification cards. Paper or plastic substrates can be particularly useful in these low-cost applications.

FIG. 18 is a flowchart 1800 of an example method for manufacturing a frequency-selective antenna system, which can be, for example, an energy harvesting system. In step 1810 a substrate is provided. The substrate can be a single layer material or a multi-layer material having a 3D structure. Step 1820 involves printing an antenna on the substrate using a conductive ink, the antenna comprising a plurality of leg elements that forms a continuous path. Each of the plurality of leg elements is individually selectable or de-selectable to change a resonant frequency of the antenna, and the selected leg elements create an antenna path length corresponding to the resonant frequency. The antenna can be a planar antenna printed on a single surface of the substrate material or can be a 3D structure with various antenna components integrated into layers of the substrate. The selectable/de-selectable leg elements can be tailored for different resonant frequency thresholds using materials tuning (e.g., type of conductive material used in the ink, and/or tailoring of material properties such as permeability, permittivity, and conductivity), electronically switchable connections, printed dielectric elements, dimensions of the leg elements (e.g., tapered width), or any combination of these. The printing in 1820 can include printing dielectric components using a dielectric ink, in some embodiments.

For embodiments where leg elements are actively selectable/de-selectable, in step 1830 an electronic circuit is coupled to the antenna. The electronic circuit has connections to the leg elements of the antenna so that the leg elements can be individually controlled. The electronic circuit can search for available frequencies in the surrounding environment and analyze power levels of each frequency. In some embodiments the electronic circuit may choose a target resonant frequency based on which frequency will be the strongest power source. In other embodiments, the electronic circuit may choose a target resonant frequency according to a wavelength that is specified to be received by a user or by a device associated with the electronic circuit and antenna. In embodiments where the antenna is an energy harvesting antenna, the method also includes step 1840 which involves coupling an energy storage component to the antenna. The energy storage component stores energy received by the antenna and can be, for example, a battery or a capacitor. In step 1850 a device is coupled to the energy storage component such that the device can be powered by the energy harvested by antenna.

Printing Inks

Various types of inks can be used to print the present antenna systems, including conventional silver or carbon inks. In some embodiments, the inks for printing the antennas can be mixtures of a carbon (e.g., graphene, etc.) and metal to achieve high conductivity. In some embodiments, the antennas are formed of printable conductive carbons comprising unique carbon materials and carbon material composites made by novel microwave plasma and thermal cracking equipment and methods, such as carbon materials disclosed in U.S. Pat. No. 9,862,606 entitled "Carbon Allotropes" and U.S. patent application Ser. No. 15/711,620 entitled "Seedless Particles with Carbon Allotropes"; both of which are owned by the assignee of the present application and are hereby fully incorporated by reference. The types of carbon materials for the various embodiments of printed components include, but are not limited to, multi-layered fullerenes, graphene, graphene oxide, sulfur-based carbons (e.g., sulfur melt diffused carbon), and carbons with metal (e.g., nickel-infused carbon, carbon with silver nanoparticles, graphene with metal). Mixtures of structured carbons such as graphenes and/or carbon nano-onions can also be used. More than one type of carbon can be utilized among the leg elements of an antenna, to tune the material properties and thus the resonant frequency threshold of each leg element.

In some embodiments, the inks include tunable, multi-layered spherical fullerenes and their hybrid forms, where the fullerenes have physical structures that are tunable by the cracking process parameters (e.g., thermal cracking or microwave cracking) used to produce them. Although conventional carbon inks can be highly conductive, some conventional materials lack the inherent capacitive and inductive properties necessary to truly produce high-gain, low cost, printable devices. Further, the high level of impurities typically found in these materials prevent consistent doping or integration with other materials to: 1) actively control and tune innate frequency of transmission and reception for signal RF and power RF; 2) enable the ability to actively steer the RF energy in a desired direction(s) to a single or plurality of devices; 3) enhance overall gain to practical levels in order to support both communications and power transmission between two or more devices. In the present embodiments, tunable carbons can be integrated into a wide variety of applicable ink formulations and can provide the necessary performance to overcome these impediments, while being effectively printed onto a wide variety of suitable substrates. Also, these carbon materials and antennas can support multimodal function. Simultaneous or multiplexed transmission and reception of various purposed forms of RF could be utilized for energy harvesting, signal transmission, or both using switched elements and/or temporal modulation. With the assistance of control hardware, these antennas can support, in addition to signal decoding, actual harvesting of the base carrier or side band frequency energy.

In some embodiments, the printable inks are transparent, such as for use in a layer of material over a visual display component.

In some embodiments, dielectric inks may be used for printing dielectric elements in the present antenna systems, as described earlier in this disclosure. Examples of dielectric materials for dielectric inks include, but are not limited to, inorganic dielectrics (e.g., aluminum oxide, tantalum oxide and titanium dioxide) and polymer dielectrics (e.g., polytetrafluoroethylene (PTFE), high density polyethylene (HDPE) and polycarbonate).

In some embodiments, magneto-dielectric (MD) inks can be used in the present antenna systems to form the antenna elements. Magneto-dielectric inks can also be used to form a layer between the substrate and printed antenna, allowing for increased antenna efficiency and miniaturization of the antenna, and serving as a decoupling material such that the antenna can operate on any type of substrate. Antenna miniaturization techniques in materials are based on the effect of electromagnetic parameters of material on the antenna size. The electrical wavelength λ is inversely proportional to the refractive index value as:

$$\lambda = \frac{c}{f_r\sqrt{\varepsilon_r\mu_r}}, \quad \text{(Eq. 6)}$$

$$\varepsilon_r = \varepsilon' - j\varepsilon'',\ \mu_r = \mu' - j\mu''. \quad \text{(Eq. 7)}$$

In Equation 6, c is the speed of light and $f_r$ is the resonant frequency of the antenna. Equation 7 shows that the permittivity c and permeability μ each have a real (ε' and μ') and imaginary component (ε" and μ"), the imaginary component being related to frequency. As can be seen by Eq. 6, the material property can determine the size of the antenna for a given resonant frequency. Conventionally, a high dielectric constant material for an antenna substrate or superstrate is used for antenna miniaturization. Increasing the relative permittivity of the substrate material, however, suffers from narrow bandwidth and low efficiency. These disadvantages are derived from the fact that the electric field remains in the high permittivity region and does not radiate. The low characteristic impedance in the high permittivity medium results in a problem for impedance matching as well On the contrary, MD materials, which have $\varepsilon_r$ and $\mu_r$ greater than one, can reduce the antenna size with better antenna performance than an antenna on a high dielectric constant material. According to known studies, properly increasing the relative permeability leads to efficient size reduction of microstrip antennas. The impedance bandwidth can be retained after the miniaturization. Using a cavity model, the radiation efficiency and bandwidth of a patch antenna placed on a lossy MD material has shown that these MD materials are effective in reducing antenna size. From this technique, it is seen that relative permittivity has a negative impact on the radiation efficiency and bandwidth, while relative permeability has a positive impact on both of them. Various antenna designs on MD materials have shown that the antenna size can be reduced without losing the radiation efficiency and bandwidth of the antenna, The present embodiments can further apply the use magneto-dielectric materials in antenna design by uniquely tuning the material properties of permeability and permittivity for a specific configuration. For example, the MD material properties can be tuned to have a particular resonant frequency for an antenna leg element, or to render an MD element to become a decoupling layer between an antenna element and a substrate.

Figure 19:
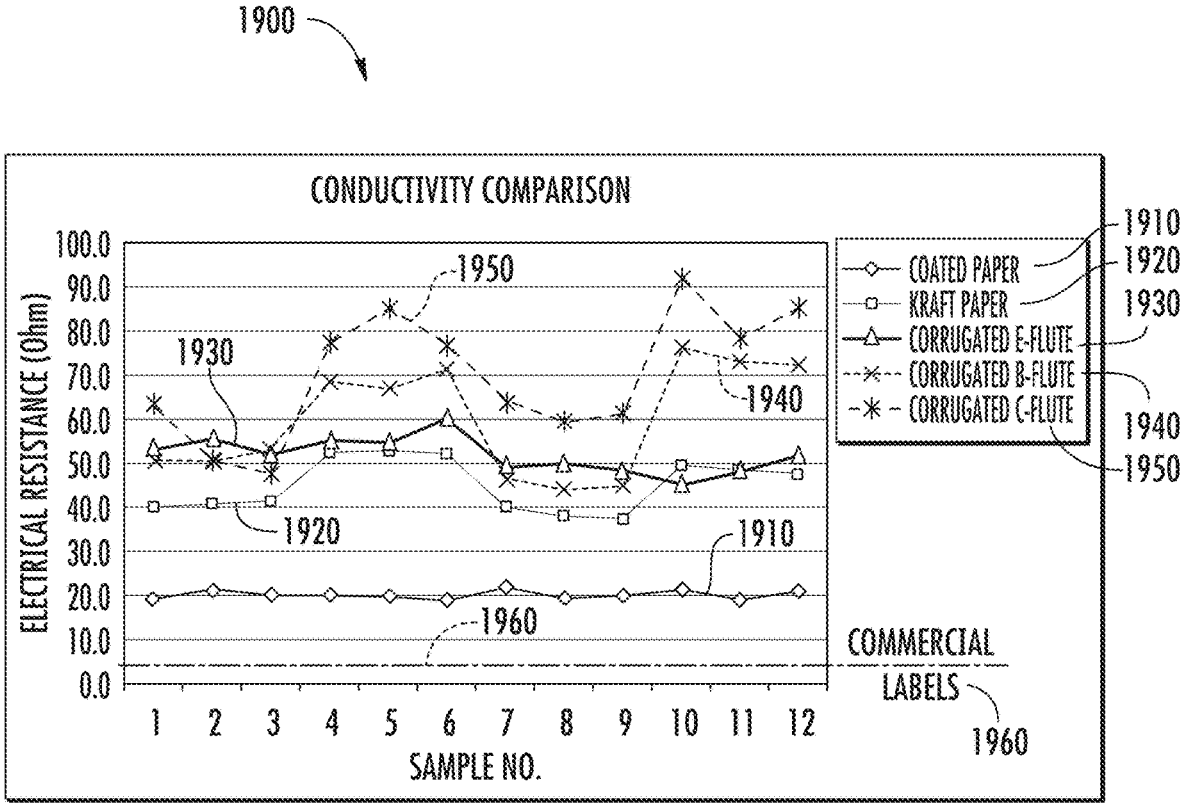
FIG. 19 (PRIOR ART)
FIG. 19 is a graph of electrical resistance for conductive materials printed on various paper substrates, as known in the art.

FIG. 19 is a graph 1900 from the prior art of electrical resistance (ohms) for multiple test samples in which a conductive coating was used on different papers. Multiple samples were tested, as indicated by the X-axis of graph 1900. The coating was printed directly onto coated paper (curve 1910), Kraft paper (curve 1920), various types of corrugated cardboard (E-flute (curve 1930), B-flute (curve 1940) and C-flute (curve 1950)) and commercial labels (curve 1960). This graph 1900 shows that the same conductive coating on different papers has a large effect on resistance. Per the previously-mentioned Equation 1, the harvesting efficiency is strongly dependent on the resistance. Experimentation clearly shows that lower resistance produces better harvesting antenna performance. Typically, materials printed directly onto cardboard yield higher resistances. In some embodiments of the present disclosure, the use of the certain ink materials, particularly using the unique carbons mentioned above, resolves this challenge. In some embodiments, inks for antenna materials can be tuned to achieve low resistance values for various paper types.

Tuning Circuit

In some embodiments, performance of the energy harvesting circuit or device or the overall electronic device is optimized by an energy harvesting optimization procedure performed either continuously or at a predetermined frequency or interval. The software and/or hardware components of such a tuning circuit monitor or determine an absolute input energy level of (or the electrical power level generated from) the harvested energy. The software and/or hardware components also adjust impedance matching components, antenna structural elements and load elements to perform an operational voltage search for the highest energy input level available. For example, an input/output (I/O) control search for the highest energy input level available can be performed by switching antenna element legs, antenna impedance matching elements, load matching elements, or any combination of these elements into and out of the system circuitry, followed by checking the indicator of the stored energy level and/or rate of depletion, as mentioned above. The configuration of these elements that results in the highest energy input level is then selected for operation of the energy harvesting circuit or device and the overall electronic device until the energy harvesting optimization procedure is repeated. Although the electronic circuit is described for energy harvesting, in other embodiments the electronic circuit can search for a specific frequency that is to be received, such as designed by a user or a device to which the electronic circuit is associated.

Figure 20:
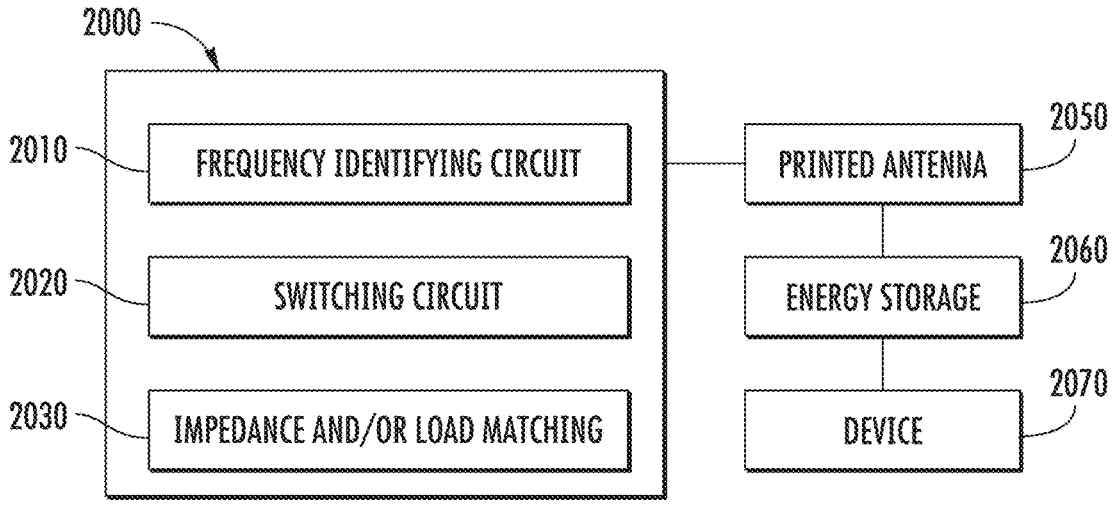
FIG. 20 is a block diagram of an electronic circuit for selecting and de-selecting frequency-selective antenna leg elements, in accordance with some embodiments.

FIG. 20 shows an embodiment of an electronic circuit 2000 that includes circuitry and processors to control energy harvesting optimization. The electronic circuit 2000 can be, for example, a microprocessor. The electronic circuit 2000 includes a frequency identifying circuit 2010 that identifies a plurality of available frequencies in an ambient environment and sets the desired frequency based on power levels of the plurality of available frequencies. The electronic circuit 2000 also includes a switching circuit 2020 that is in communication with individual connections of leg elements in an antenna 2050 to select or de-select the plurality of leg elements. Thus, electronic circuit 2000 switches in and/or out (i.e., electrically shorting out or connecting together in serial or parallel) different antenna leg elements and different impedance-matching or load-matching elements 2030 that may also be present in electronic circuit 2000. In this manner, the software and/or hardware components operating under an energy harvesting optimization procedure generate a series of different connection configurations for the antenna leg elements. The electronic circuit 2000 can also control impedance-matching elements and a load, and determine an absolute input energy level of the harvested energy for each configuration. In embodiments where the antenna 2050 is an energy harvesting antenna, the system also includes an energy storage component 2060 that can be used to store energy received by the antenna 2050. The energy storage component 2060 can be, for example, a battery or a capacitor. The energy storage component 2060 is connected to a device 2070 that is powered by the energy harvested by antenna 2050.

Figure 21:
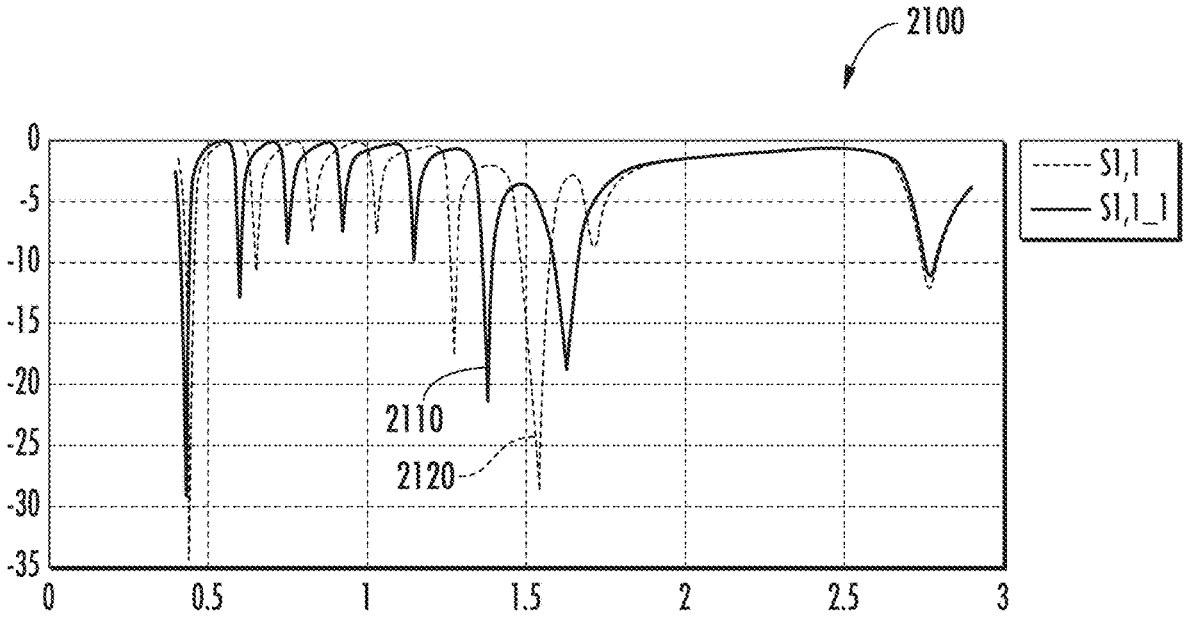
FIG. 21 is a graph of frequency response for different antenna configurations, in accordance with some embodiments.

The switching in and/or out of these antenna leg elements and impedance matching elements for different configurations achieves different bandwidth and frequency reception as shown in example graph 2100 in FIG. 21, where the solid line 2110 and dashed line 2120 illustrate the results of two example configurations for different maximum energy harvesting situations. The configuration that results in the highest energy input level for a given energy harvesting situation is then selected for operation of the energy harvesting circuit or device and the overall electronic device to which the power is being supplied. The energy harvesting optimization procedure is repeated continually or periodically, because the energy harvesting situation can potentially change at any moment due to changes in the available frequencies in the ambient environment or changes in the physical orientation of the antenna.

The energy harvesting optimization procedure is beneficial because the environment in which the energy harvesting circuit or device is to be used is typically unknown and can potentially change. Thus, the frequency of the available EM radiation is unknown. EM radiation at any appropriate EM frequency may be present in the environment. Two frequencies that are commonly used in the same environment are 915 MHz and 2.45 GHz, but many other frequency signals may also be present. However, it is not known beforehand which frequency will have the signal with the highest amplitude or power level, and therefore will be the best candidate for energy harvesting. At a first time period, for example, a first signal at a first frequency may be present with a very high amplitude or power level, while a second signal at a second frequency may have a much lower amplitude or power level, so that only the first signal is usable for the energy harvesting circuit or device. Yet, at a second time period, the second signal may be present with the higher amplitude or power level, while the first signal has the lower amplitude or power level, so that only the second signal is usable for the energy harvesting circuit or device. At still another time, both signals may be present with usable amplitude or power levels. In other words, at different times, different combinations of one or more signals at one or more frequencies may be present in the environment at usable amplitude or power levels.

As a consequence of the fact that the usable signal frequencies will be unknown, the appropriate antenna configuration needed for maximum energy harvesting capability in any given environment or at any given time is also likely to be unknown, because each antenna is typically tuned to receive signals of only a particular frequency or frequency band. Similarly, the appropriate impedance (needed for impedance matching) of associated circuitry electrically connected to the antenna is also unknown. The energy harvesting optimization procedure, therefore, enables the energy harvesting circuit or device and/or the associated electronic circuit of the overall electronic device to switch in and out various antenna elements and impedance matching elements in different combinations or configurations, thereby tuning the overall antenna for the best reception of all (or almost all, most, or a significant portion) of the usable signal frequencies in the environment, so that the harvesting of the available energy (or the generating of electrical power therefrom) is maximized or optimized for any given situation or environment.

The energy optimization is particularly well-suited for IC device integration embodiment, where the electronics for the energy harvesting circuit or device are integrated with various logic devices (e.g., intelligent microprocessors or ASIC devices) in the same IC die, as well as in the same platform packaging. The electronics for the energy harvesting circuits or devices generally include, but are not limited to, impedance matching circuitry, rectification circuitry, regulation circuitry, and charge regulation circuitry (e.g., for storage devices, such as capacitors or batteries), among others. The electronics for the various logic devices generally include, but are not limited to, a central processing unit (CPU), a co-processor, an ASIC, a reduced instruction set computing (RISC) processor, an Advanced RISC Machines (TM) (ARM) processor, and lower level logic to perform intelligent functions, among others. The electronics for the various logic devices can also generally include communication components, e.g., in accordance with the Bluetooth Low Energy (BLE) standards, near-field communication (NFC) protocols, the ZIGBEE specification, the WIFI standards, the WIMAX standards, etc.

Reference has been made in detail to embodiments of the disclosed invention, one or more examples of which have been illustrated in the accompanying figures. Each example has been provided by way of explanation of the present technology, not as a limitation of the present technology. In fact, while the specification has been described in detail with respect to specific embodiments of the invention, it will be appreciated that those skilled in the art, upon attaining an understanding of the foregoing, may readily conceive of alterations to, variations of, and equivalents to these embodiments. For instance, features illustrated or described as part of one embodiment may be used with another embodiment to yield a still further embodiment. Thus, it is intended that the present subject matter covers all such modifications and variations within the scope of the appended claims and their equivalents. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

What is claimed:

1. An antenna system comprising:

a substrate; and an antenna on the substrate, the antenna comprising a first leg element and a second leg element that form at least a portion of an antenna path length;

wherein:

the first leg element comprises a first resonant frequency threshold and a first conductive ink having a first material property, wherein the first resonant frequency threshold is dependent on the first material property and is a threshold above which the first leg element will no longer respond;

the second leg element comprises a second resonant frequency threshold and a second conductive ink having a second material property, wherein the second resonant frequency threshold is dependent on the second material property and is a threshold above which the second leg element will no longer respond; and the first resonant frequency threshold is different from the second resonant frequency threshold due to a difference between the first material property and the second material property.

2. The antenna system of claim 1, wherein:

the second resonant frequency threshold is higher than the first resonant frequency threshold; and the first leg element is passively de-selected when a received frequency is above the first resonant frequency threshold, decreasing the antenna path length by being inactive.

3. The antenna system of claim 2, wherein the second leg element is passively selected by resonating when the received frequency is below the second resonant frequency threshold.

4. The antenna system of claim 1, wherein:

the first resonant frequency threshold is based on a first electrical impedance, the first electrical impedance being dependent on the first material property; and the second resonant frequency threshold is based on a second electrical impedance, the second electrical impedance being dependent on the second material property.

5. The antenna system of claim 1, wherein the first material property and the second material property are selected from the group consisting of: a permeability, a permittivity, and a conductivity.

6. The antenna system of claim 1 further comprising a third leg element having a third material property and a third resonant frequency threshold that is dependent on the third material property, wherein the second leg element is located between the first leg element and the third leg element; and wherein the first material property is greater than the second material property, and the second material property is greater than the third material property, such that the first resonant frequency threshold is less than the second resonant frequency threshold, and the second resonant frequency threshold is less than the third resonant frequency threshold.

7. The antenna system of claim 1, wherein:

the substrate comprises a first layer, a second layer stacked on the first layer, and an intermediate layer between the first layer and the second layer;

the first leg element and the second leg element are on the first layer and form a first antenna arm of the antenna; and the antenna further comprises a second antenna arm on the second layer.

8. The antenna system of claim 7, wherein the substrate is cardboard, and the intermediate layer is a corrugated medium.

9. The antenna system of claim 1, wherein:

the first conductive ink and the second conductive ink are carbon-based; and the substrate comprises paper.

10. The antenna system of claim 1, wherein the antenna is an energy harvester.

11. An energy harvesting system comprising:

A) an antenna system comprising:

a substrate; and an antenna on the substrate, the antenna comprising a plurality of leg elements, wherein a leg element in the plurality of leg elements comprises a carbon-based conductive ink and wherein the plurality of leg elements forms a continuous path;

wherein at least one leg element in the plurality of leg elements is configured to be passively selected or de-selected to change a resonant frequency of the antenna and create an antenna path length corresponding to the resonant frequency; and B) an energy storage component coupled to the at least one leg element in the plurality of leg elements.

12. The energy harvesting system of claim 11, wherein each leg element in the plurality of leg elements is configured to be passively selected or de-selected by a difference in material property of the leg element that creates a difference in resonant frequency threshold between the plurality of leg elements.

13. The energy harvesting system of claim 11, wherein:

a first leg element of the plurality of leg elements comprises a first material having a first inductance;

a second leg element of the plurality of leg elements comprises a second material having a second inductance; and the first inductance and the second inductance are different from each other.

14. The energy harvesting system of claim 11, wherein:

a first leg element of the plurality of leg elements comprises a first material having a first permittivity;

a second leg element of the plurality of leg elements comprises a second material having a second permittivity; and the first permittivity and the second permittivity are different from each other.

15. The energy harvesting system of claim 11, wherein:

a first leg element of the plurality of leg elements comprises a first material having a first permeability;

a second leg element of the plurality of leg elements comprises a second material having a second permeability; and the first permeability and the second permeability are different from each other.

16. An antenna comprising:

a first leg element composed of a first carbon-based conductive ink;

a second leg element composed of a second carbon-based conductive ink, the second leg element being in electrical contact with the first leg element; and a third leg element composed of a third carbon-based conductive ink, the third leg element being in electrical contact with the second leg element;

wherein:

the first leg element is configured to be passively selected to resonate below about 5 GHz;

a first combination of the first leg element and the second leg element is configured to be passively selected to resonate at frequencies in a first range of frequencies;

a second combination of the first leg element and the second leg element and the third leg element is configured to be passively selected to resonate at frequencies in a second range of frequencies; and at least some of the first range of frequencies are higher than at least some of the second range of frequencies.

17. The antenna of claim 16, wherein the first leg element, and the second leg element and the third leg element are printed on a shipping box.

18. The antenna of claim 16, further comprising a substrate made of at least one of paper, glass, or plastic.

19. The antenna of claim 18, wherein the substrate is at least one of a label or a card.

20. The antenna of claim 16, wherein the first leg element, the first combination, and the second combination comprise antenna path lengths that are different from each other.

21. The antenna of claim 16, wherein:

the first range of frequencies is in a range of about 2.45 GHz to about 5 GHz; and the second range of frequencies is in a range of about 915 MHz to about 2.45 GHz.

* * * * *